US009257041B2

(12) United States Patent
Scofield et al.

(10) Patent No.: US 9,257,041 B2
(45) Date of Patent: Feb. 9, 2016

(54) PREDICTING EXPECTED ROAD TRAFFIC CONDITIONS BASED ON HISTORICAL AND CURRENT DATA

(75) Inventors: Christopher Laurence Scofield, Seattle, WA (US); Robert C. Cahn, Federal Way, WA (US); Jesse Hersch, Bellevue, WA (US); Wayne Stoppler, Bothell, WA (US); Valerie Raybold Yakich, Renton, WA (US); Te-Ming Huang, Bellevue, WA (US); Alec Barker, Woodinville, WA (US)

(73) Assignee: Inrix, Inc., Kirkland, WA (US)

( * ) Notice: Subject to any disclaimer, the term of this patent is extended or adjusted under 35 U.S.C. 154(b) by 1574 days.

(21) Appl. No.: 12/765,742

(22) Filed: Apr. 22, 2010
(Under 37 CFR 1.47)

(65) Prior Publication Data

US 2011/0106416 A1 May 5, 2011

Related U.S. Application Data

(60) Provisional application No. 61/171,574, filed on Apr. 22, 2009.

(51) Int. Cl.
*G08G 1/00* (2006.01)
*G08G 1/01* (2006.01)

(52) U.S. Cl.
CPC ..... *G08G 1/0104* (2013.01)

(58) Field of Classification Search
CPC . G08G 1/0104; G08G 1/0108; G08G 1/0112; G08G 1/0116; G08G 1/012; G08G 1/0125; G08G 1/0129; G08G 1/0133; G08G 1/0137; G08G 1/0141; G08G 1/0145
USPC ..... 701/117, 119
See application file for complete search history.

(56) References Cited

U.S. PATENT DOCUMENTS 3,582,620 A 6/1971 Noetinger ..... 235/150.24
3,626,413 A 12/1971 Zachmann ..... 343/8

(Continued)

FOREIGN PATENT DOCUMENTS

DE 19928082 A1 12/2000
DE 100 63 763 7/2002

(Continued)

OTHER PUBLICATIONS

"Dash Express Automotive Navigation System," retrieved Aug. 3, 2007, from http://www.dash.net/product.php, 1 page.

(Continued)

*Primary Examiner* — Mussa A Shaawat
*Assistant Examiner* — Kyung Kim
(74) *Attorney, Agent, or Firm* — Seed IP Law Group PLLC

(57) ABSTRACT

Techniques are described for determining and using information regarding expected road traffic flow conditions information for vehicles traveling on roads. The expected road traffic flow conditions for a particular portion of a road may be generated by combining historical representative information about road traffic flow conditions for that road portion with current information about actual traffic flow on or near that road portion. The combination may, for example, provide benefits for estimating expected traffic flow conditions information for roads with structural flow obstructions that cause reduced traffic flow at certain road locations and times—for example, the expected traffic flow conditions information may be based at least in part on fitting or otherwise adapting partial actual traffic flow information about a vehicle's actual travel path to a historical travel profile for a road that includes representative traffic flow information for various combinations of road locations and time periods.

31 Claims, 9 Drawing Sheets

(56) References Cited

U.S. PATENT DOCUMENTS

| | | | | |
|---|---|---|---|---|
| 4,866,438 | A | 9/1989 | Knisch | 340/936 |
| 4,985,705 | A | 1/1991 | Stammler | 342/69 |
| 5,289,183 | A | 2/1994 | Hassett et al. | 340/905 |
| 5,337,082 | A | 8/1994 | Fredericks | 342/69 |
| 5,465,289 | A | 11/1995 | Kennedy, Jr. | 379/59 |
| 5,590,217 | A | 12/1996 | Toyama | 382/104 |
| 5,610,821 | A | 3/1997 | Gazis et al. | 364/444.2 |
| 5,663,720 | A | 9/1997 | Weissman | 340/934 |
| 5,696,502 | A | 12/1997 | Busch et al. | 340/905 |
| 5,745,865 | A | 4/1998 | Rostoker et al. | 701/117 |
| 5,827,712 | A | 10/1998 | Yokoyama et al. | 435/193 |
| 6,011,515 | A | 1/2000 | Radcliffe et al. | 342/453 |
| 6,119,013 | A | 9/2000 | Maloney et al. | 455/456 |
| 6,150,961 | A | 11/2000 | Alewine et al. | 340/995 |
| 6,292,742 | B1 | 9/2001 | Heimann et al. | 707/117 |
| 6,317,686 | B1 | 11/2001 | Ran | 701/210 |
| 6,401,027 | B1 | 6/2002 | Xu et al. | 701/117 |
| 6,463,382 | B1 | 10/2002 | Bullock | 701/117 |
| 6,480,783 | B1 | 11/2002 | Myr | 701/117 |
| 6,490,519 | B1 | 12/2002 | Lapidot et al. | 701/117 |
| 6,496,773 | B1 | 12/2002 | Olsson | 701/117 |
| 6,505,114 | B2 | 1/2003 | Luciani | 701/117 |
| 6,574,548 | B2 | 6/2003 | DeKock et al. | 701/117 |
| 6,587,781 | B2 | 7/2003 | Feldman et al. | 701/117 |
| 6,594,576 | B2 | 7/2003 | Fan et al. | 701/117 |
| 6,650,948 | B1 | 11/2003 | Atkinson et al. | 700/66 |
| 6,664,922 | B1 | 12/2003 | Fan | 342/357.1 |
| 6,728,628 | B2 | 4/2004 | Peterson | 701/117 |
| 6,781,523 | B2 | 8/2004 | Matsui et al. | 340/910 |
| 6,832,140 | B2 | 12/2004 | Fan et al. | 701/33 |
| 6,842,620 | B2 | 1/2005 | Smith et al. | 455/456.1 |
| 6,862,524 | B1 | 3/2005 | Nagda et al. | 701/209 |
| 6,882,313 | B1 | 4/2005 | Fan et al. | 342/457 |
| 6,882,930 | B2 | 4/2005 | Trayford et al. | 701/117 |
| 6,922,566 | B2 | 7/2005 | Puranik et al. | 455/456.2 |
| 6,973,319 | B2 | 12/2005 | Ormson | 455/456.1 |
| 6,989,765 | B2 | 1/2006 | Gueziec | 340/905 |
| 7,026,958 | B2 | 4/2006 | Wainfan et al. | 340/995.13 |
| 7,027,915 | B2 | 4/2006 | Craine | 701/117 |
| 7,069,143 | B2 | 6/2006 | Peterson | 701/117 |
| 7,096,115 | B1 | 8/2006 | Groth et al. | 701/117 |
| 7,116,326 | B2 | 10/2006 | Soulchin et al. | 345/440 |
| 7,161,497 | B2 | 1/2007 | Gueziec | 340/905 |
| 7,221,287 | B2 | 5/2007 | Gueziec et al. | 340/905 |
| 7,363,144 | B2 | 4/2008 | Liu et al. | 701/117 |
| 7,375,649 | B2 | 5/2008 | Gueziec | 340/905 |
| 7,508,321 | B2 | 3/2009 | Gueziec et al. | 340/905 |
| 7,519,564 | B2 | 4/2009 | Horvitz | 706/12 |
| 7,557,730 | B2 | 7/2009 | Gueziec | 340/905 |
| 7,610,145 | B2 | 10/2009 | Kantarjiev et al. | 701/204 |
| 2001/0027373 | A1 | 10/2001 | Bates et al. | 701/117 |
| 2002/0051464 | A1 | 5/2002 | Sin et al. | 370/466 |
| 2003/0069683 | A1 | 4/2003 | Lapidot et al. | 701/117 |
| 2004/0034467 | A1 | 2/2004 | Sampedro et al. | 701/201 |
| 2004/0038671 | A1 | 2/2004 | Trayford et al. | 455/414.3 |
| 2004/0249568 | A1 | 12/2004 | Endo et al. | 701/209 |
| 2005/0140525 | A1 | 6/2005 | Tomita et al. | 340/995.13 |
| 2005/0206534 | A1 | 9/2005 | Yamane et al. | 340/994 |
| 2006/0025925 | A1 | 2/2006 | Fushiki et al. | 701/210 |
| 2006/0074551 | A1 | 4/2006 | Zaitsu et al. | 701/209 |
| 2006/0103674 | A1 | 5/2006 | Horvitz et al. | 345/629 |
| 2006/0106530 | A1 | 5/2006 | Horvitz et al. | 701/117 |
| 2006/0106599 | A1 | 5/2006 | Horvitz | 704/219 |
| 2006/0106743 | A1 | 5/2006 | Horvitz | 706/21 |
| 2006/0122846 | A1 | 6/2006 | Burr et al. | 705/1 |
| 2006/0149461 | A1 | 7/2006 | Rowley et al. | 701/202 |
| 2006/0155464 | A1 | 7/2006 | Smartt | 701/208 |
| 2006/0178806 | A1 | 8/2006 | Liu et al. | 701/117 |
| 2006/0224797 | A1 | 10/2006 | Parish et al. | 710/62 |
| 2006/0229802 | A1 | 10/2006 | Vertelney et al. | 701/200 |
| 2007/0005419 | A1 | 1/2007 | Horvitz et al. | 705/14 |
| 2007/0073477 | A1 | 3/2007 | Krumm et al. | 701/209 |
| 2007/0199050 | A1 | 8/2007 | Meier | 726/4 |
| 2007/0208492 | A1 | 9/2007 | Downs et al. | 701/117 |
| 2007/0208494 | A1 | 9/2007 | Chapman et al. | 701/117 |
| 2007/0208495 | A1 | 9/2007 | Chapman et al. | 701/117 |
| 2007/0208496 | A1 | 9/2007 | Downs et al. | 701/117 |
| 2007/0208497 | A1 | 9/2007 | Downs et al. | 701/117 |
| 2007/0208498 | A1 | 9/2007 | Barker et al. | 701/117 |
| 2008/0004802 | A1* | 1/2008 | Horvitz | 701/209 |
| 2008/0021791 | A1 | 1/2008 | Steelberg et al. | 705/26 |
| 2008/0059115 | A1 | 3/2008 | Wilkinson | 702/179 |
| 2008/0071465 | A1 | 3/2008 | Chapman et al. | 701/117 |
| 2008/0071466 | A1 | 3/2008 | Downs et al. | 701/117 |
| 2008/0133517 | A1 | 6/2008 | Kapoor et al. | 707/6 |
| 2008/0275309 | A1 | 11/2008 | Stivoric et al. | 600/300 |
| 2008/0278328 | A1 | 11/2008 | Chand et al. | 340/572.1 |
| 2009/0118996 | A1 | 5/2009 | Kantarjiev et al. | 701/119 |

FOREIGN PATENT DOCUMENTS

| | | |
|---|---|---|
| DE | 102004015880 | 11/2004 |
| DE | 103 36 590 | 2/2005 |
| JP | 200690872 | 4/2006 |
| WO | 2004/021305 | 3/2004 |
| WO | 2004/021306 | 3/2004 |
| WO | 2006/005906 | 1/2006 |

OTHER PUBLICATIONS

"Dash Navigation Unveils First Internet-Connected Auto Navigation Device," Sep. 26, 2006, Dash Navigation™, Inc., retrieved Aug. 3, 2007, from http://www.dash.net/news_pr-060925.php, 1 page.

"Inrix Advances Navigation with 'Nationwide Average Speeds'," Aug. 7, 2006, Inrix, Inc., retrieved Jul. 19, 2007, from http://www.inrix.com/news_NationwideAverageSpeeds_07Aug2006.asp, 1 page.

"Inrix Historical Traffic Improves Consumer Navigation Experience," Jul. 18, 2007, Inrix, Inc., retrieved Jul. 19, 2007, from http://www.inrix.com/news_NAS_18July2007.asp, 2 pages.

"LandSonar, Inc Announces First-Ever Nationwide Traffic-Prediction Product," Jan. 22, 2006, LandSonar, Inc., retrieved Jul. 20, 2007, from http://www.landsonar.com/?p=55, 3 pages.

U.S. Appl. No. 60/628,267, Horvitz, filed Nov. 16, 2004.

"Navteq Launches Navteq Traffic Patterns™ Database: *Historic Traffic Data is the Basis for Predicting Traffic Behavior and Enhancing Routes*," Jan. 5, 2007, Navteq, retrieved Jul. 19, 2007, from http://www.navteq.com/webapps/NewsUserServlet?action=NewsDetail&newsId=479, 2 pages.

"TrafficCast International and LandSonar Introduce LPS Plus," Mar. 1, 2007, LandSonar, Inc., retrieved Jul. 19, 2007, from http://www.landsonar.com/?p=117, 2 pages.

"About LandSonar, Inc.," retrieved Apr. 27, 2006, from http://www.landsonar.com/?page_id=2, 2 pages.

"Award Abstract—#0349460—SBIR Phase II: Animated Real-Time Road Traffic Visualization for Broadcast and the Internet," National Science Foundation, retrieved Jul. 31, 2006, from http://www.nsf.gov/awardsearch/showAward.do?AwardNumber=0349460, 2 pages.

"Global Positioning Systems > Tracking Systems in the Yahoo! Directory," Yahoo!® Small Business Directory, retrieved Feb. 8, 2006, from http://dir.yahoo.com/Business_and_Economy/Business_to_Business/Navigation/Global_Positioning_Systems/Tracking_Systems, 8 pages.

"IntelliOne Launches Need4Speed, Two-Week Road Test of Groundbreaking Live Traffic Measurement and Reporting Technology," www.IntelliOne.com, Aug. 1, 2006, 2 pages.

"Powerful Tool Crunches Commutes," Mar. 8, 2005, National Science Foundation, retrieved Jan. 20, 2006, from http://www.beatthetraffic.com/aboutus/nsf20050308.htm, 2 pages.

"Seattle Area Traffic—Central Puget Sound Travel Times," Washington State Department of Transportation, retrieved Jan. 20, 2006, from http://www.wsdot.wa.gov/traffic/seattle/traveltimes/, 3 pages.

"Technology Overview," retrieved Apr. 27, 2006, from http://www.landsonar.com/?page_id=20, 3 pages.

BeatTheTraffic.com: The Right Traffic at the Right Time™, Homepage, retrieved Jan. 20, 2006, from http://www.beatthetraffic.com/, 1 page.

Bluestein, G., "Traffic Jam? 2 Atlanta Companies Say Look to Your Cell Phone," The Mercury News, Nov. 5, 2006, downloaded Nov. 6,

(56) References Cited

OTHER PUBLICATIONS 2006, from http://www.mercury news.com/mld/mercurynews/news/breaking_news/15937597.htm, 2 pages.
Graham-Rowe, D., "Smart Traffic Forecast Offers Seven-Day Predictions," Jun. 29, 2005, NewScientist.com, retrieved Jan. 20, 2006, from http://www.newscientist.com/article.ns?id=dn7605&print=true, 2 pages.
Green, D., "Navigating by Phone," Apr. 28, 2004, Palo Alto Weekly Online Edition, retrieved Jul. 27, 2006, from http://www.paloaltoonline.com/weekly/morgue/2004/2004_04_28.zipdash28ja.shtml, 3 pages.
Slawski, W., "Ending Gridlock with Google Driving Assistance (Zipdash Re-Emerges)," Jul. 6, 2006, retrieved Jul. 27, 2006, from http://www.seobythesea.com/?p=240, 3 pages.
Smith, B. "OmniTRACS Keeps on Trucking," Dec. 1, 2005, WirelessWeek.com, retrieved Feb. 7, 2006, from http://www.wirelessweek.com/index.asp?layout=articlePrint&articleID=CA6287997, 2 pages.
Utter, D., "Google Mobilizes Traffic Data," Jul. 25, 2006, webpronews.com, retrieved Jul. 27, 2006, from http://www.webpronews.com/topnews/topnews/wpn-60-20060725GoogleMobilizesTrafficData.html, 4 pages.

* cited by examiner

Travel Profile information for example Road R203 at Time Period Y

Travel Profile information for example Road R203 at Time Period Y+2

PREDICTING EXPECTED ROAD TRAFFIC CONDITIONS BASED ON HISTORICAL AND CURRENT DATA

CROSS REFERENCE TO RELATED APPLICATIONS

This application claims the benefit of U.S. Provisional Patent Application No. 61/171,574, filed Apr. 22, 2009 and entitled "Predicting Expected Road Traffic Conditions Based On Historical And Current Data," which is hereby incorporated by reference in its entirety.

TECHNICAL FIELD

The following disclosure relates generally to techniques for combining historical and current information about road traffic conditions in order to generate expected information regarding current and/or future road traffic conditions, such as for use in improving travel over roads in one or more geographic areas.

BACKGROUND

As road traffic has increased, the effects of increasing traffic congestion have had growing deleterious effects on business and government operations and on personal well-being. Accordingly, efforts have been made to combat the increasing traffic congestion in various ways, such as by obtaining information about current traffic conditions and providing the information to individuals and organizations. Such current traffic condition information may be provided to interested parties in various ways (e.g., via radio broadcasts, an Internet Web site that displays a map of a geographical area with color-coded information about current traffic congestion on some major roads in the geographical area, information sent to cellular telephones and other portable consumer devices, etc.).

One source for obtaining information about current traffic conditions includes observations manually supplied by humans (e.g., traffic helicopters that provide general information about traffic flow and accidents, reports called in by drivers via cellphones, etc.), while another source in some larger metropolitan areas is networks of traffic sensors capable of measuring traffic flow for various roads in the area (e.g., via sensors embedded in the road pavement). Unfortunately, various problems exist with respect to such information, as well as to information provided by other similar sources. For example, many roads do not have road sensors (e.g., geographic areas that do not have networks of road sensors and/or arterial roads that are not sufficiently large to have road sensors as part of a nearby network), and even roads that have road sensors may often not provide accurate data (e.g., sensors that are broken and do not provide any data or provide inaccurate data). In addition, while observations that are manually supplied by human may provide some value in limited situations, such information is typically limited to only a few areas at a time and typically lacks sufficient detail to be of significant use.

DETAILED DESCRIPTION

Figure 1:
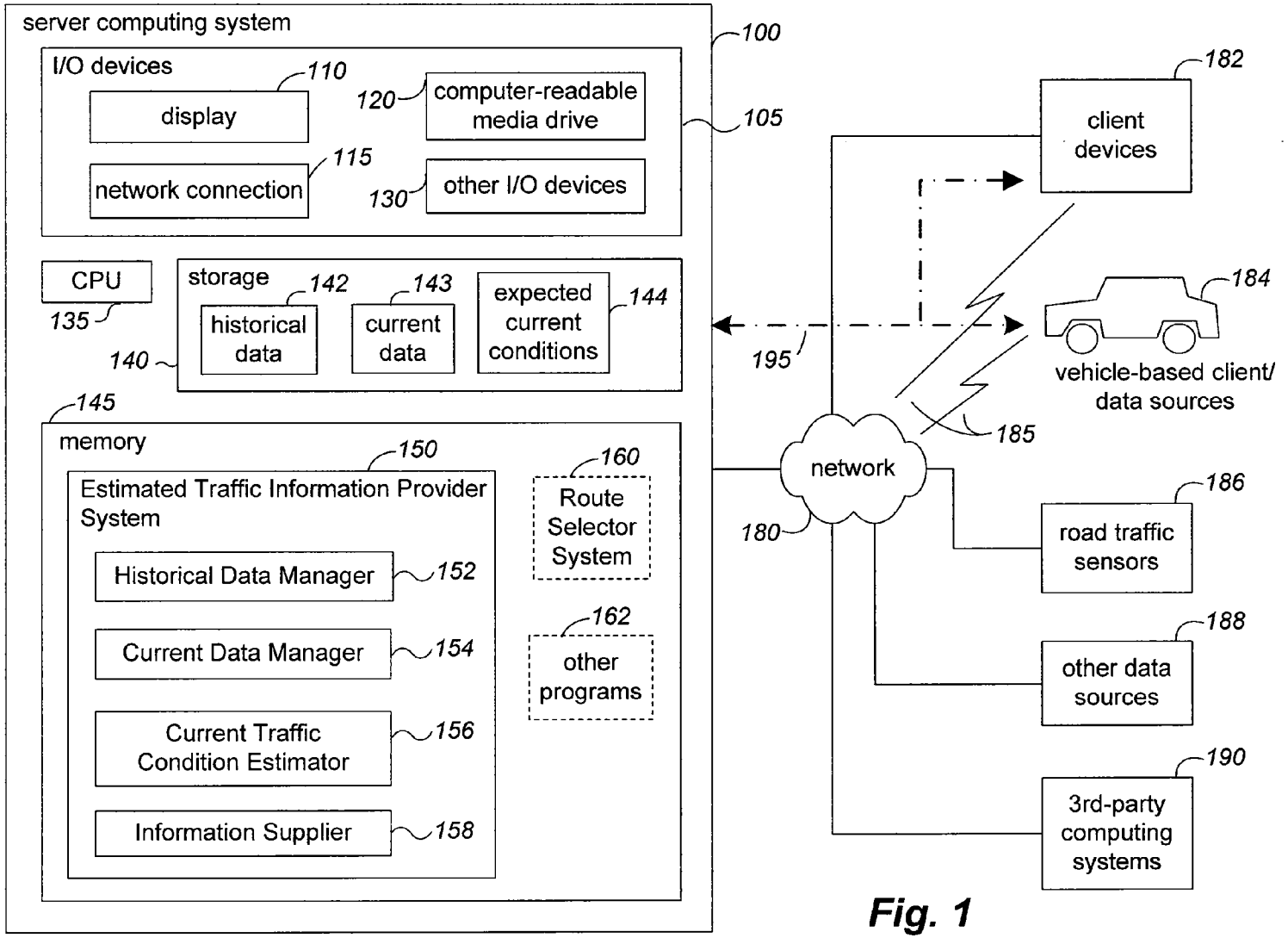
FIG. 1 is a block diagram illustrating a computing system suitable for executing an embodiment of the described Estimated Traffic Information Provider system.

Techniques are described for generating information regarding expected current and/or future road traffic flow conditions in various ways, and for using generated traffic flow condition information in various ways. In at least some embodiments, the expected road traffic flow conditions for a particular segment or other portion of a road are generated by combining historical representative information about road traffic flow conditions for that road portion with current or otherwise recent information about actual traffic flow on or near that road portion. The historical information may include, for example, data readings from physical sensors that are near or embedded in the roads and/or data samples from vehicles and other mobile data sources traveling on the roads, and may be filtered, conditioned and/or aggregated in various ways (e.g., to represent average traffic conditions for particular time periods of particular days of the week or other types of days). The current or otherwise recent information about actual traffic flow may include, for example, data samples that are obtained from vehicles and/or other mobile data sources that are currently or recently traveling on particular roads and road portions of interest. Such techniques for combining historical representative traffic flow information and recent actual traffic flow information may, for example, provide benefits for estimating expected traffic flow conditions information for vehicles traveling on roads with structural flow obstructions that cause reduced traffic flow at certain road locations and during at least some time—in particular, the estimating of the expected traffic flow conditions information may be based at least in part on fitting or otherwise adapting partial actual traffic flow information about a vehicle's actual travel path to a historical travel profile for a road that includes representative traffic flow information for various combinations of road locations and time periods. Additional details related to generating and using expected traffic flow condition information in particular manners are included herein. In addition, in at least some embodiments, some or all of the described techniques are automatically performed under control of an embodiment of an Estimated Traffic Information Provider ("ETIP") system, as described below.

Expected information may be generated for a variety of types of useful measures of traffic conditions in various embodiments, such as for each of multiple road locations (e.g., road segments, road map links, particular points on roads, etc.) or other portions of roads during each of multiple time periods. For example, such traffic conditions measures may include an average speed, a volume of traffic for an indicated period of time, an average occupancy time of one or more traffic sensors or other locations on a road (e.g., to indicate the average percentage of time that a vehicle is over or otherwise activating a sensor), one of multiple enumerated levels of road congestion (e.g., measured based on one or more other traffic conditions measures), etc. Values for each such traffic conditions measure may be represented at varying levels of precision in varying embodiments. For example, values for the average speed conditions measure may be represented at the nearest 1-MPH ("mile per hour") increment, the nearest 5-MPH increment, in 5-MPH buckets (e.g., 0-5 MPH, 6-10 MPH, 11-15 MPH, etc.), in fractions of 1-MPH increments at varying degrees of precision, etc. Such traffic conditions measures may also be measured and represented in absolute terms and/or in relative terms (e.g., to represent a difference from typical or from maximum). Additional details related to the generation of the expected information are included below.

In some embodiments, historical traffic data may include information about traffic for various target roads of interest in a geographical area, such as for a network of selected roads in the geographic area. In some embodiments, one or more roads in a given geographic region may be modeled or represented by the use of road links. Each road link may be used to represent a portion of a road, such as by dividing a given physical road into multiple road links. For example, each link might be a particular length, such as a one-mile length of the road. Such road links may be defined, for example, by governmental or private bodies that create maps (e.g., by a government standard; by commercial map companies as a quasi-standard or de facto standard; etc.) and/or by a provider of the Expected Traffic Information Provider system (e.g., manually and/or in an automated manner), such that a given road may be represented with different road links by different entities.

In addition, in some embodiments one or more roads in a given geographic region may be modeled or represented by the use of road segments, such as road segments defined by a provider of the Expected Traffic Information Provider system (e.g., manually and/or in an automated manner). Each road segment may be used to represent a portion of a road (or of multiple roads) that has similar traffic conditions characteristics for one or more road links (or portions thereof) that are part of the road segment. Thus, a given physical road may be divided into multiple road segments, such as with multiple road segments that correspond to successive portions of the road, or alternatively in some embodiments by having overlapping or have intervening road portions that are not part of any road segment. In addition, each road segment may be selected so as to include some or all of one or more road links, such as a series of multiple road links. Furthermore, a road segment may represent one or more lanes of travel on a given physical road. Accordingly, a particular multi-lane road that has one or more lanes for travel in each of two directions may be associated with at least two road segments, with at least one road segment associated with travel in one direction and with at least one other road segment associated with travel in the other direction. Similarly, if a road link represents a multi-lane road that has one or more lanes for travel in each of two directions, at least two road segments may be associated with the road link to represent the different directions of travel. In addition, multiple lanes of a road for travel in a single direction may be represented by multiple road segments in some situations, such as if the lanes have differing travel condition characteristics. For example, a given freeway system may have express or high occupancy vehicle ("HOV") lanes that may be beneficial to represent by way of road segments distinct from road segments representing the regular (e.g., non-HOV) lanes traveling in the same direction as the express or HOV lanes. Road segments may further be connected to or otherwise associated with other adjacent road segments, thereby forming a chain or network of road segments.

The roads and/or road segments/links for which expected traffic conditions information is generated may be selected in various manners in various embodiments. In some embodiments, expected traffic conditions information is generated for each of multiple geographic areas (e.g., metropolitan areas), with each geographic area having a network of multiple inter-connected roads. Such geographic areas may be selected in various ways, such as based on areas in which historical traffic data is readily available (e.g., based on networks of road sensors for at least some of the roads in the area), in which traffic congestion is a significant problem, and/or in which a high volume of road traffic occurs at times. In some such embodiments, the roads for which expected traffic conditions information is generated include those roads for which historical traffic conditions information is available, while in other embodiments the selection of such roads may be based at least in part on one or more other factors (e.g., based on size or capacity of the roads, such as to include freeways and major highways; based on the role the roads play in carrying traffic, such as to include arterial roads and collector roads that are primary alternatives to larger capacity roads such as freeways and major highways; based on functional class of the roads, such as is designated by the Federal Highway Administration; etc.). In addition, in some embodiments, expected traffic conditions information is generated for some or all roads in one or more large regions, such as each of one or more states or countries (e.g., to generate nationwide data for the United States and/or for other countries or regions). In some such embodiments, all roads of one or more functional classes in the region may be covered, such as to include all interstate freeways, all freeways and highways, all freeways and highways and major arterials, all local and/or collector roads, all roads, etc. In other embodiments, expected traffic conditions information generation calculations may be made for a single road, regardless of its size and/or inter-relationship with other roads.

In at least some embodiments, expected traffic conditions information for a particular road link or other portion of road is generated for each of one or more traffic flow aggregation classifications or categories, such as for some or all road links or other road portions. In particular, in at least some embodiments, various time-based categories are selected, and expected traffic conditions information is separately generated for each of the time-based categories. As previously noted, in some embodiments, various time periods of interest may be selected, and each time-based category may be associated with one or more such time periods. As one example, time periods may be based at least in part on information about day-of-week and/or time-of-day (e.g., hour-of-day, minute-of-hour-of-day, etc.), such that each time-based category may correspond to one or more days-of-week and one or more times-of-day on those days-of-week. If, for example, each day-of-week and each hour-of-day are separately modeled with time-based categories, 168 (24*7) time-based categories may be used (e.g., with one category being Mondays from 9 am-9:59 am, another category being Mondays from 10 am-10:59 am, another category being Sundays from 9 am-9:59 am, etc.). In this example, expected traffic conditions information for a road link and a particular time-based category, such as Mondays from 10 am-10:59 am, is generated at least in part by aggregating historical traffic information that corresponds to that road link and category, such as for traffic conditions information reported for that road link on prior Mondays between 10 am and 10:59 am.

Alternatively, a particular time-based category may include a grouping of multiple days-of-week and/or hours-of-day, such as if the grouped times are likely to have similar traffic conditions information (e.g., to group days of week and times of day corresponding to similar work commute-based times or non-commute-based times). A non-exclusive list of examples of day-of-week groupings include the following: (a) Monday-Thursday, Friday, and Saturday-Sunday; (b) Monday-Friday and Saturday-Sunday; (c) Monday-Thursday, Friday, Saturday, and Sunday; and (d) Monday-Friday, Saturday, and Sunday. A non-exclusive list of examples of time-of-day groupings include the following: (a) 6 am-8:59 am, 9 am-2:59 pm, 3 pm-8:59 pm, and 9 pm-5:59 am; and (b) 6 am-6:59 pm and 7 pm-5:59 am. Accordingly, one example group of time-based categories for which expected traffic conditions information may be generated is as follows:

| Category | Day-Of-Week | Time-Of-Day |
|---|---|---|
| 1 | Monday-Thursday | 6 am-8:59 am |
| 2 | Monday-Thursday | 9 am-2:59 pm |
| 3 | Monday-Thursday | 3 pm-8:59 pm |
| 4 | Monday-Thursday | 9 pm-5:59 am |
| 5 | Friday | 6 am-8:59 am |
| 6 | Friday | 9 am-2:59 pm |
| 7 | Friday | 3 pm-8:59 pm |
| 8 | Friday | 9 pm-5:59 am |
| 9 | Saturday-Sunday | 6 am-6:59 pm |
| 10 | Saturday-Sunday | 7 pm-5:59 am |

Furthermore, in some embodiments, time periods for time-based categories may be selected for time increments of less than an hour, such as for 15-minute, 5-minute, or 1-minute intervals. If, for example, each minute-of-day for each day-of-week is separately represented, 10,080 (60*24*7) time-based categories may be used (e.g., with one category being Mondays at 9:00 am, another category being Mondays at 9:01 am, another category being Sundays at 9:01 am, etc.). In such an embodiment, if sufficient historical data is available, expected traffic conditions information may be generated for a particular road link and a particular time-based category using only historical traffic information that corresponds to that road link and the particular minute for the time-based category, while in other embodiments historical information for a larger time duration may be used. For example, for an example time-based category corresponding to Mondays at 9:01 am, historical information from a rolling time duration of one hour (or another time duration) surrounding that time may be used (e.g., on Mondays from 8:31 am-9:31 am, on Mondays from 8:01 am-9:01 am, on Mondays from 9:01 am-10:01 am, etc.). In other embodiments, periods of time may be defined based on other than time-of-day and day-of-week information, such as based on day-of-month, day-of-year, week-of-month, week-of-year, etc.

In addition, in at least some embodiments, the traffic flow aggregation classifications or categories used for expected traffic conditions information may be based on temporary or other variable conditions other than time that alter or otherwise affect traffic conditions, whether instead of or in addition to time-based categories. In particular, in at least some embodiments, various condition-based categories may be selected, and expected traffic conditions information may be separately generated for each of the condition-based categories for one or more road links or other road portions. Each such condition-based category may be associated with one or more traffic-altering conditions of one or more types. For example, in some embodiments, traffic-altering conditions related to a particular road link or other road portion that are used for condition-based categories for that road link/portion may be based on one or more of the following: weather status (e.g., based on weather in a geographic area that includes the road link/portion); status regarding occurrence of a non-periodic event that affects travel on the road link/portion (e.g., based on an event with sufficient attendance to affect travel on the road link/portion, such as a major sporting event, concert, performance, etc.); status regarding a current season or other specified group of days during the year; status regarding occurrence of one or more types of holidays or related days; status regarding occurrence of a traffic accident that affects travel on the road link/portion (e.g., a current or recent traffic accident on the road link/portion or on nearby road links/portions); status regarding road work that affects travel on the road link/portion (e.g., current or recent road work on the road link/portion or on nearby road links/portions); and status regarding school sessions that affects travel on the road link/portion (e.g., a session for a particular nearby school, sessions for most or all schools in a geographic area that includes the road link/portion, etc.).

For illustrative purposes, some embodiments are described below in which specific types of measures of expected traffic conditions are generated in specific ways using specific types of input, and in which generated measures are used in various specific ways. However, it will be understood that such information may be generated in other manners and using other types of input data in other embodiments, that the described techniques may be used in a wide variety of other situations, that information for other types of traffic conditions measures or other measures may similarly be generated and used in various ways, and that the invention is thus not limited to the exemplary details provided.

In some embodiments, various historical data for particular roads may be available, such as to reflect traffic patterns on both highways and secondary roads, and various current or otherwise recent traffic condition information may also be available for those roads (e.g., real-time or near-real-time data samples from vehicles and/or other mobile data sources that are currently or recently traveling on particular roads, also referred to herein as "recent traffic probe data"). If so, the historical traffic information may be combined with the recent traffic probe data to provide estimates of expected current and/or future traffic conditions that have benefits beyond that available from either the historical traffic information alone or the recent traffic probe data alone. As one example, such techniques for combining historical traffic information and recent traffic probe data may provide particular benefits in at least some embodiments for estimating expected average traffic speeds and travel times on roads with structural flow obstructions that are part of the road, such as signal lights, stop signs, traffic circles, speed bumps, crosswalks, intersections, rail crossings, merging lanes or roads, etc., and/or with non-structural flow obstructions that are not part of the road, such as distracting or interesting sights visible from the road, occasional animal crossings, etc. In addition, such techniques for combining historical traffic information and recent traffic probe data may provide particular benefits in at least some embodiments for estimating expected average traffic speeds and travel times on secondary roads that are not highways, such as arterial roads and/or other local city streets, while in other embodiments such techniques may be used with highway roads, whether in addition to or instead of non-highway roads.

In the following illustrative embodiment, a particular illustrated technique for combining historical traffic information with recent traffic probe data to generate estimates of expected current and/or future traffic conditions is described, although it will be appreciated that other embodiments may use other techniques. In the illustrated technique, activities are performed to generate estimates of expected current and/or future traffic conditions, as follows: computing or otherwise generating a "road profile" or "travel profile" for a particular portion of a road; linking together multiple recent traffic probe data points from an individual vehicle to represent portions of the actual travel path of the vehicle, for each of numerous vehicles; and fitting the multiple probe data points from a vehicle's actual travel path to the generated profile for a road portion to which the actual travel path corresponds. The fitting of the multiple probe data points from a vehicle's actual travel path to a generated travel profile may include various activities in various embodiments, such as interpolating travel speeds or other travel flow condition information for the vehicle for portions of the actual travel path for which probe data points are not available, adjusting a portion of the generated travel profile to which the available probe data points are fitted to correspond to different time periods than an actual time period for the actual travel path and/or to correspond to different locations in the travel profile than the actual locations of the actual travel path, etc. Additional exemplary details related to these types of activities follow.

Computing A Travel/Road Profile

A road or travel profile as discussed herein may include representative traffic flow conditions values or other information, such as average or otherwise typical traffic speeds averaged over a period of time for a portion of road. Consider an example portion of road that covers several miles. Average speeds of vehicles at some or all points or other locations on this road portion may be of interest at various times. By collecting reported speeds for this road portion over an extended period of time (referred to as the road "history"), such as at least in part from vehicles or other mobile data sources that travel on the road portion and/or at least in part from road sensors associated with locations on the road portion, the average reported speed may be estimated for some or all points on the road portion, and error estimates (or "error bars") around an average reported speed for a point may further be generated. As one example, the standard deviation of the average reported speed may be used as a estimate of the error of the average speed for a particular time of day in at least some embodiments. Thus the travel/road profile may be represented or construed in some situations as a 3-dimensional surface, with the x-dimension being time of day, the y-dimension being the distance along the road portion from a starting point, and the z-dimension being the average speed. In other embodiments, a travel/road profile may have other forms, such as a 2-dimensional surface with the x-dimension being one of time-of-day and distance along the road portion from a starting point, and the y-dimension being average speed or other representative traffic flow conditions information.

Even if historical traffic data is collected for the road portion over a very long time, there may be some locations of the road portion for which there is not sufficient data to generate an average speed or other representative traffic flow conditions information, depending on the spatial resolution used to represent the locations (e.g., every foot, every 10 feet, every 100 feet, every 1000 feet, etc.). In such situations, historical data may only be available at intermittent points along the road portion. Actions to smooth this historical data and interpolate/extrapolate data for other points may be performed in various manners in various embodiments. For example, one approach may be the fitting of a parametric surface to the historical data points, while another approach may be the fitting of a non-parametric surface to the historical data points. Yet another approach involves the creation of a "grid" of values that approximates a surface. The grid creation process involves first organizing the road portion into fixed-distance sections (optionally based on defined road links), which will be referred to as "edges" for purposes of this discussion. Such edges may have a length that is determined by the density of the historical data, or instead by other conditions (e.g., based on defined road links). In either case, after the road portion is divided into a fixed number of edges of set length, the average speed and standard deviation for a given time of day and given edge may be computed by using reported speeds (e.g., from physical road sensors and/or from mobile data sources) on that edge or other edges over the road history for that time of day.

In some situations, the average speed in neighboring edges may be very similar, such as for at least some highways in which average speeds are often constant over long stretches. Accordingly, a "segmentation" step may be performed in generating the travel/road profile, involving the merging of neighboring edges in order to reduce the total number of segments representing a road. A number of merging techniques may be used in various embodiments, and a particular example of one such merging technique follows. In particular, beginning at the first point in the road portion, consider the average speed difference between the first and the second edges. The statistical significance of this difference may be calculated to decide whether to merge these two edges—for example, given two edges i and i+1, the following is used in the example merging technique to compute the t-statistics of the two edges, $$\Delta v_i = v_i - v_{(i+1)}$$
$$\Delta\sigma_i = \sqrt{\frac{(n_i - 1)\sigma_i^2 + (n_{i+1} - 1)\sigma_{i+1}^2}{n_i + n_{i+1} - 2}},$$
$$t_i = \mathrm{abs}\left(\frac{\Delta v}{\Delta\sigma_i\sqrt{\frac{1}{n_i} + \frac{1}{n_{i+1}}}}\right)$$

where $v_i$ represents velocity, $\sigma_i$ represents the standard deviation, and $n_i$ is the number of historical data samples in edge i collected during a length of time for a particular time period (e.g., data may be collected for a length of time of 2 years for a particular time period of 4 pm to 5 pm on Mondays). If the t value is smaller than a certain threshold, the two edges will be merged together to form a new segment. The same procedure may then be performed on the new segment (if the first and second segments are merged) and the edge next to it (in this example, the third segment). This procedure is repeated until all the edges are checked. Other factors may also be incorporated as additional or alternative criteria for merging two similar edges, such as absolute speed difference between the two edges, difference in the standard deviation of the speed between two edges, etc.

In some situations, sufficient data may not be available to compute average speeds for each minute of a day, for example, even when edges are merged. If so, a 24-hour period may be divided into larger time periods (or "time bins"). For example, in a particular embodiment and situation, a time bin may be a 1-hour period, a multi-hour period (e.g., the morning congestion period from 5 am-10 am), an entire day of the week, etc. As discussed above, the merging activities are performed with respect to particular time bins and edges.

Determining Vehicle Travel Paths

Data samples from vehicles and other mobile data sources often include indications of Point (e.g., GPS coordinates), Heading and Speed (PHS), and may also include a proxy identity or some other form of identifier for the vehicle or other device reporting a particular PHS data sample, although the identifier may, for example, be a unique number that does not reveal particular identifying data for a vehicle/device or its driver or other user. In determining information for a travel path, some or all of the data points from a particular vehicle or other device may be gathered, and used to used to represent an actual travel path for that vehicle/device. In particular, in some embodiments, a particular travel path may be the longest set of data points which may be linked together for that vehicle/device. Travel paths may be very long (many miles) or very short (a few feet). Travel paths may be broken in various manners depending on the embodiment, such as if a vehicle/device reports zero speeds (or speeds below a defined speed threshold) for a period of time longer than a defined time threshold, if a vehicle/device reports headings whose variability exceeds a defined threshold, etc.

Fitting A Vehicle Travel Path To A Travel Profile

Consider a travel/road profile for a particular road portion. Historical speeds may rise and fall as a function of distance along the road, such as to reflect persistent congestion regions (e.g., based on traffic flow obstructions such as signal lights, etc.). Recent traffic probe data for this road portion, as represented by travel paths for one or more vehicles/devices, may not match the historical data in the road profile for various reasons. For example, the lack of match may be because travel conditions are different for the particular time corresponding to the travel path(s) rather than a larger time period or time bin for which the historical speed is averaged, because external conditions may be different (e.g., there is a school holiday on the day corresponding to the travel path(s), causing a common congestion region to have much less traffic and resulting congestion), because some or all of the vehicle(s)/device(s) that reported the travel path(s) passed through a traffic light without stopping instead of having to wait as is more typical for the historical average speeds, etc. Performing fitting activities enable a particular vehicle/device actual travel path to be matched to the travel/road profile. Conceptually, such activities involve matching recent traffic probe data speed estimates to the historical speeds represented by the road profile, for the time of day in which the recent traffic probe data has been reported. For example, point pairs may be separated in time by 1 minute or more, and during this time, the reporting vehicle/device may travel a significant distance. Fitting activities may include performing "warping" activities to, for some or all edges of the roadway for which sufficient (e.g., any) traffic probe data points is not available, estimate the travel times over those edges that are most consistent with the travel/road profile. For example, if two speed data points are reported from the same vehicle and are separated by a period of time that is sufficiently large that the vehicle may travel a significant distance, it may be desirable to be able to estimate multiple particular speeds at multiple particular intermediate locations between the data points. In order to do so, historical data may be used to estimate such speeds between the data points, with the described fitting techniques performing such speed estimation between data points in such a manner that the overall travel time is consistent with the time between the reported data points, but with the estimated multiple speeds varying in a manner that reflects variations in typical historical speed variations for the multiple intermediate locations between the data points.

As one particular example, the following equation fits point-pair speeds and computed travel time to the historical speed travel profile of the road between the point pair. With respect to the following equation, it is assumed that the historical average speed $v_i^{avg}$ and its standard deviation $\sigma_i$ are available for each segment i of the road portion for which the travel time will be fitted. The travel time $t_i^{avg}$ and associated standard deviation in the travel time $\sigma_i^t$ are computed for segment i according to:

$$t_i^{avg} = \frac{d_i}{v_i^{avg}} \tag{1}$$

and $$\sigma_i^t = \sigma_i \frac{d_i}{(v_i^{avg})^2} \tag{2}$$

where $d_i$ is the distance of road segment i, and distance and speed have been appropriately converted to common units. A weight W is then produced according to:

$$W = \frac{\Delta t}{\sum_{i=1}^{n} \sigma_i^t}. \tag{3}$$

where the difference between the historical travel time and the measured travel time for the paired-points is given by $\Delta t = t_{avg} - t^{measured}$. Note that W is independent of road segment in this equation. Finally, the estimated travel time $t_i^{est}$ for road segment i is given by $$t_i^{est} = t_i^{avg} + W\sigma_i^t. \tag{4}$$

and point speed for segment i can be computed by $$v_i^{est} = \frac{d_i}{t_i^{est}}.$$

With respect to such time warping, several special cases may arise and be addressed in various manners. For example, when travel times for paired-points are much less than the historical average, the algorithm may estimate very large speeds for some segments (those for which $\sigma_i^t$ is large). To limit this effect, equation (4) may be modified as follows:

$$t_i^{est} = \mathrm{Max}\left(t_i^{avg} + W\sigma_i^t, \frac{d_i}{\alpha v^{ref}}\right) \tag{5}$$

where $v^{ref}$ is the reference speed for the road in which the segment occurs (e.g., the $85^{th}$ percentile of all speeds on the road), and $\alpha$ is a factor that controls some percentage of the reference speed. Typically $\alpha$ is set to 1.2, so that the estimated travel time for road segment i is never greater than that achievable by exceeding the reference speed by 20%. In addition, if the point speed is known, the weight W may be set to zero, and the speed for the segment replaced by the known speed. There may also be some portions of the road in which such fitting is applied and other portions in which such fitting is not used (or is used to a lesser degree). If so, particular road portions may be predefined to have fitting applied or not, or models may be defined to dynamically detect corresponding differences between road portions, so as to enable fitting to be applied differentially on these portions.

In the examples above, travel path data has been matched within a fixed time bin, such that the fitting occurs within a single time bin on the travel/road profile. In other embodiments and situations, however, the current speeds from recent traffic probe data may significantly differ from the representative average speeds or other typical speeds of the historical travel profile, and if so the fitting may take place in both the space (e.g., road location) and time dimensions. Conceptually, this is the same as finding a path across the road profile surface that has the smallest degree of adjustment applied to the travel path. One example of accomplishing this is the following: for each spatial segment, evaluate all time bins and select the one that requires the lowest degree of adjusting of the travel path, optionally applying a cost factor that is an increasing function of the time difference between the current time bin and the best fitting time bin, so as to tend to improve the continuity of the path across the surface. In other embodiments, fitting may take place in both the space and time dimensions in other situations, and/or fitting may occur with respect to the space dimension without changing the time dimension.

As described above, historical traffic data may be combined with recent traffic flow condition information from vehicles and other devices in various manners and in order to provide various benefits. A non-exclusive list of aspects of the described techniques that provide particular benefits includes the following: the use of historical data to estimate accurate travel times and speeds for data points between reported recent traffic probe data points; the computation of a historical travel/road profile in which the size of spatial and temporal divisions is a function of sample sizes; the creation of a travel path that includes all point pairs from a single vehicle; the splitting of a travel path when vehicle speeds drop below a threshold for a period of time exceeding a temporal threshold; performing fitting of an actual travel path to a travel profile for a road portion by computing accurate travel times for locations of the road portion as a function of the historical travel times at those locations and a total travel time that includes those locations; performing fitting of an actual travel path to a 3-D travel profile for a road portion in a manner that optimizes the path across the 3-D profile by finding the best matching time bin and/or road location; etc. It will be appreciated that other aspects may similarly provide various benefits.

Figure 2A:
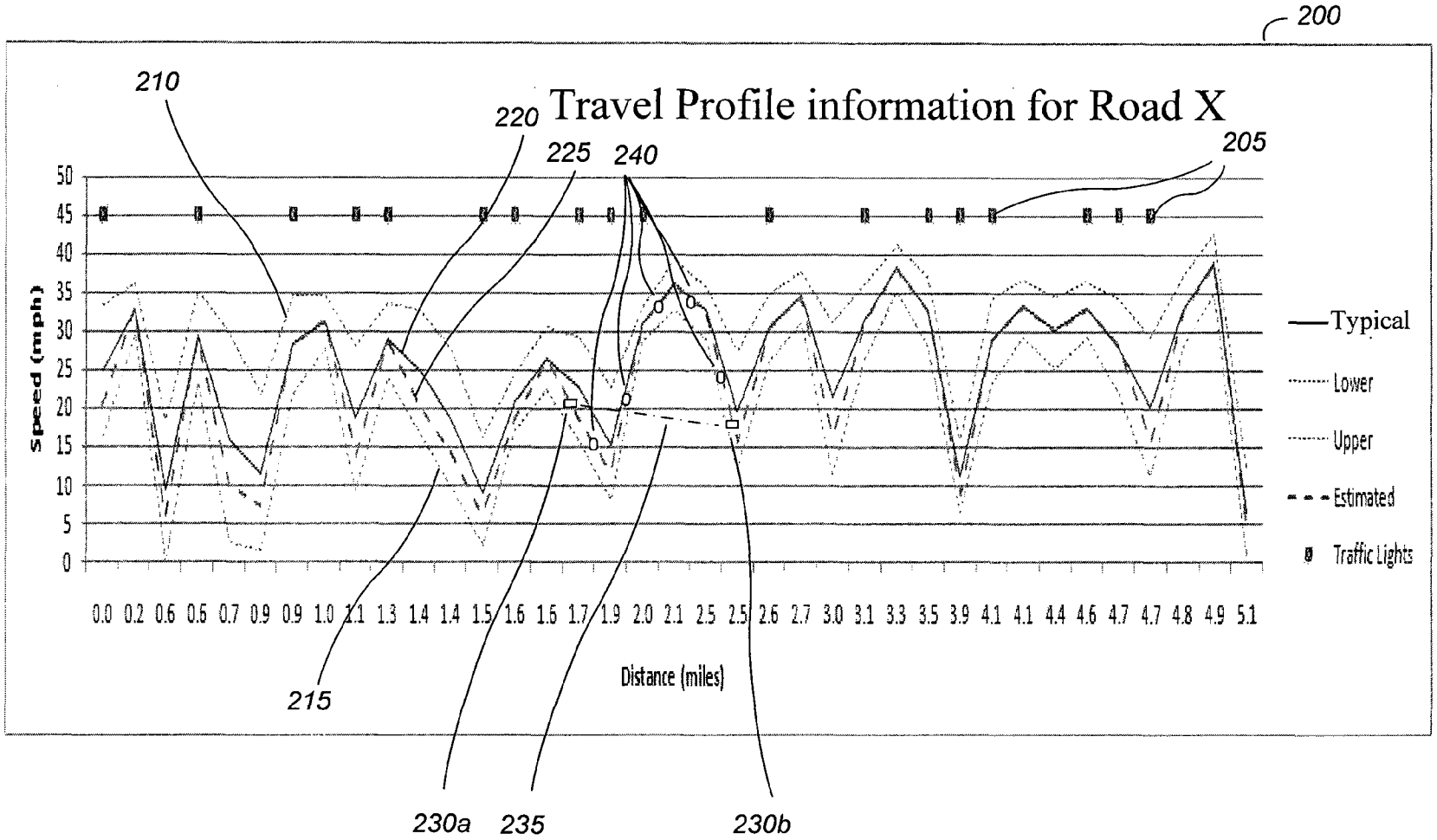
FIGS. 2A-2D illustrate examples of using historical and current information about road traffic conditions in various manners.
Figure 2B:
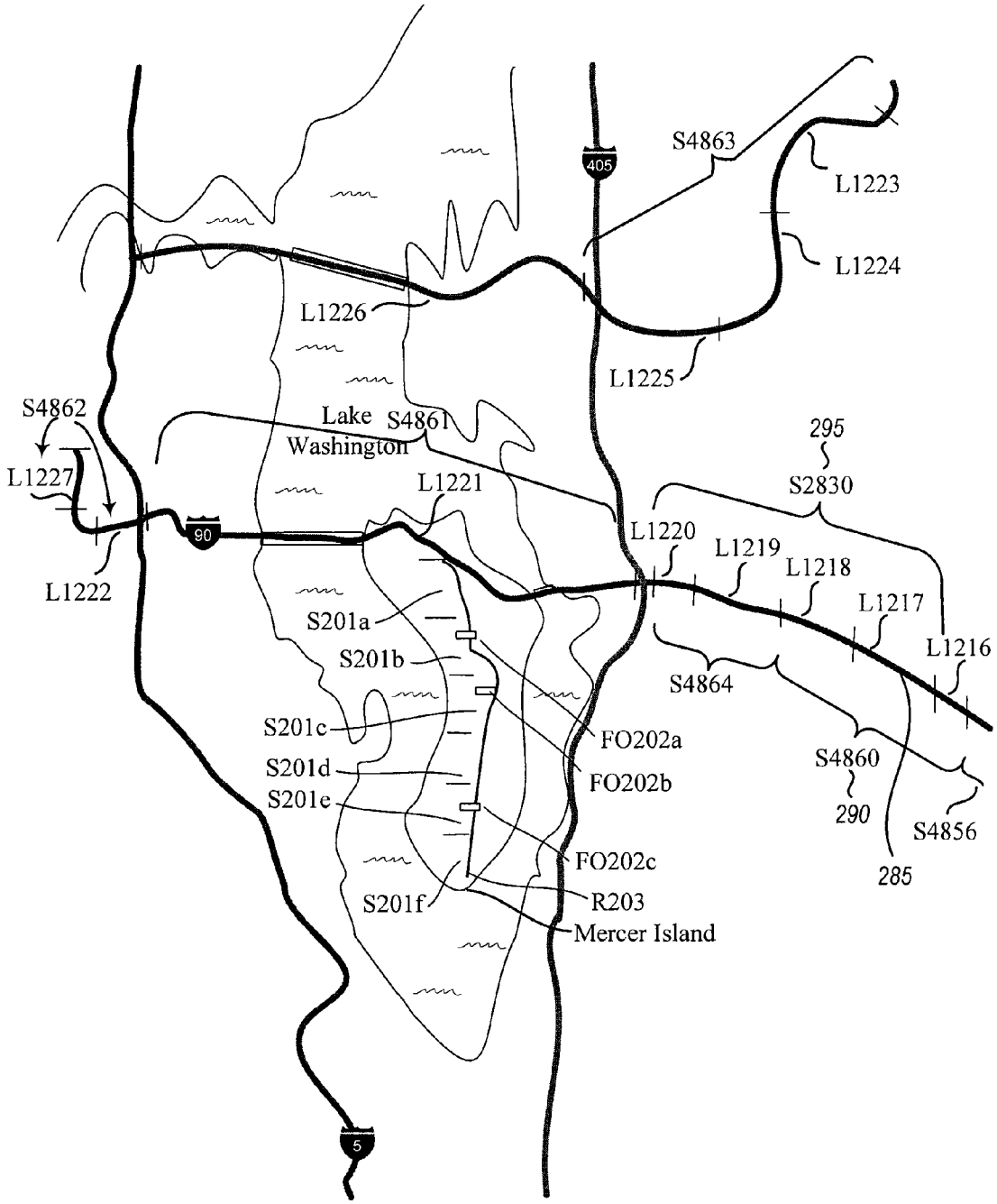
Figure 2C:
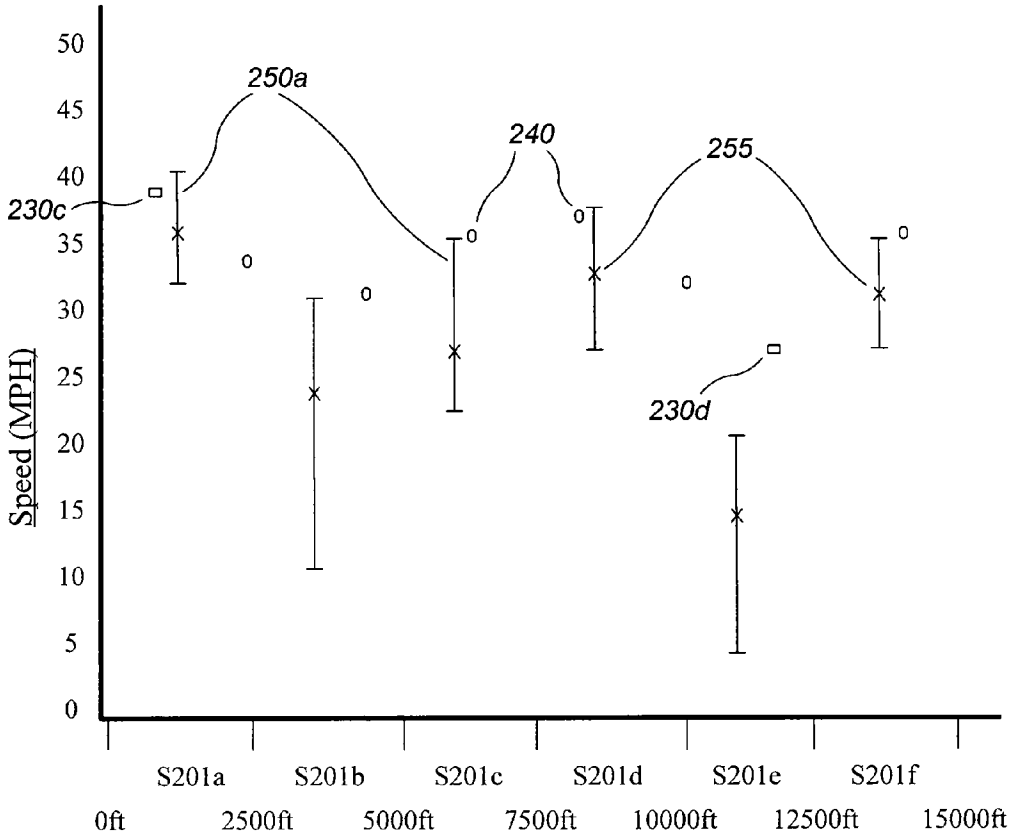
Figure 2D:
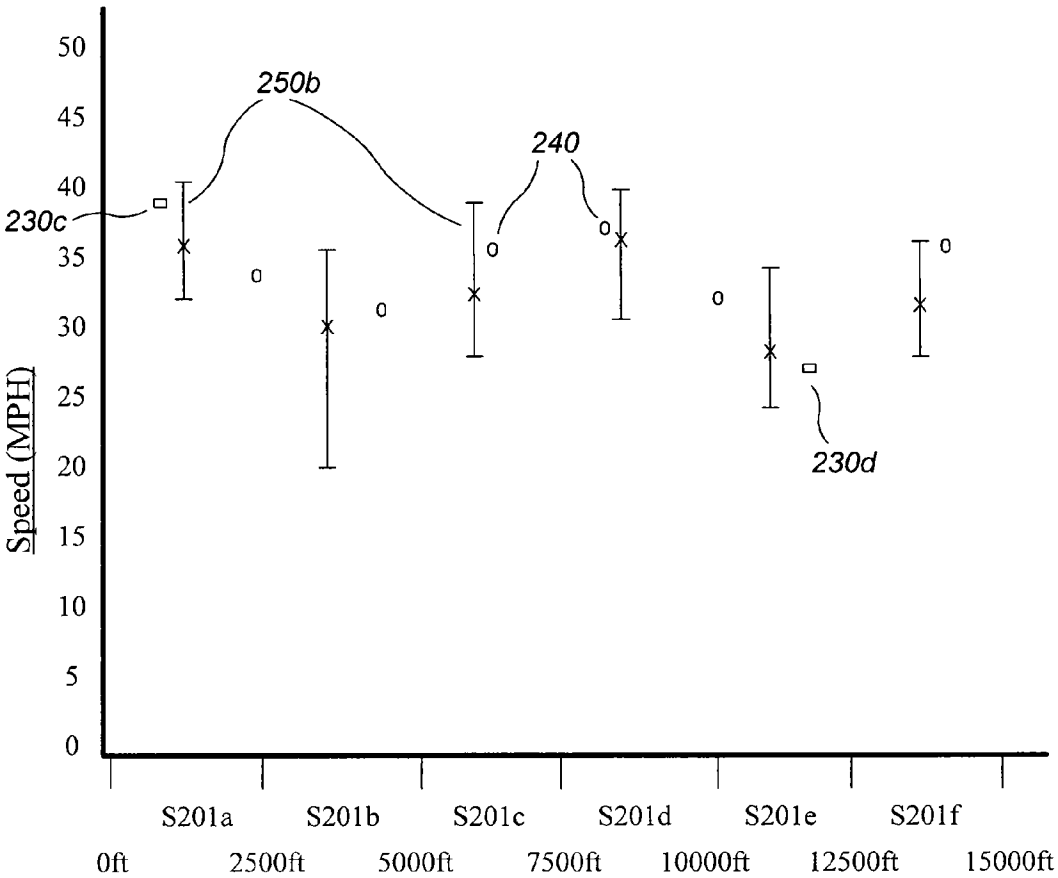

FIGS. 2A-2D illustrate examples of using historical and current information about road traffic conditions in various manners. In particular, FIGS. 2A and 2C-2D illustrate examples of using travel profile information, and FIG. 2B illustrates an example of road information for which travel profiles may be generated.

With respect to FIG. 2A, it illustrates example information 200 that represents at least a portion of a generated historical travel profile for an example road portion of a city street or other arterial road (referred to in this example as "Road X"). In particular, the example information 200 includes a 2-D graph for which the x-axis corresponds to distance along a defined road portion from a starting point, and the y-axis corresponds to traffic speed. As discussed elsewhere, in some embodiments a travel profile may contain representative traffic flow conditions information in at least three dimensions, such as if representative traffic flow conditions information is aggregated separately for different time periods, and in such embodiments the example information 200 may correspond to a slice or portion of the historical travel profile for a single time period.

In this example, the historical travel profile information includes a line 220 on the graph that shows typical representative traffic flow conditions information for each of a plurality of locations along the road portion, such as may be average historical traffic flow for a given location for a time period based on historical information that is aggregated from a plurality of vehicles at a plurality of prior times. In addition, in this example, the information 200 further includes lines 215 and 210 that represent lower and upper estimates, respectively, of the historical representative traffic flow conditions information—as discussed in greater detail elsewhere, such lower and upper estimates may represent a range of possible or likely values for the historical representative traffic flow conditions information, such as to correspond to, for example, minimum and maximum historical values, one or more standard deviations from the typical values based on the historical information, etc. In addition, such ranges of historical representative traffic flow conditions information values for a given road location and time period may be represented in other manners in other embodiments (e.g., with error bars, as illustrated in FIGS. 2C and 2D), or may not be used in some embodiments. The example information 200 further includes indications 205 of various structural traffic flow obstructions at various road locations, which in this example correspond to traffic lights, and with the various displayed representative traffic flow conditions information values differing at various of the road locations (and at various time periods, not shown) based at least in part on these flow obstructions.

The example information 200 further includes a line 225 that corresponds to estimated traffic flow conditions information for an actual travel path of a vehicle along the road portion represented by the travel profile information, with the line 225 being estimated using the historical representative traffic flow conditions information values of the historical travel profile in combination with partial actual traffic flow information for the vehicle. For example, the line 225 includes indications of two actual data samples 230 that include actual traffic flow speed values of the vehicle at two indicated road locations (in this example, at locations that are approximately 1.7 and 2.5 miles from the starting point, and with actual traffic flow speeds of approximately 21 mph and 18 mph, respectively). If data sample 230*a* at the 1.7 mile distance location occurred at a first time T, and if the second data sample 230*b* at the 2.5 mile distance location occurred at a second time T+2.5 minutes, for example, an average speed for the 0.8 miles traveled during those 2.5 minutes is approximately 19 mph. In the absence of the historical travel profile information, traffic speeds 235 could be estimated in an unsophisticated manner by assuming a straight-line change between the actual traffic flow speeds from the data samples 230. However, doing so ignores the three flow obstructions that occur on the road between the locations of the actual data samples 230, with the corresponding variations in the historical representative traffic flow conditions information values.

Accordingly, rather than estimating traffic flow speeds in accordance with the straight-line 235, the described techniques in at least some embodiments determine expected traffic flow speed values 240 based on fitting the actual traffic flow values to the historical travel profile, such as automatically by an embodiment of the estimated traffic information provider system, and with those values 240 being included as part of the line 225 between the two data samples 230. In this example, both of the actual traffic flow speeds for the two actual data samples 230 are below the typical traffic flow speeds for that road location during the relevant time period, and the expected traffic flow speed values 240 have been generated based on the historical representative traffic flow conditions information values of the travel profile for the road locations between the two actual data samples 230, such that the line 225 has a shape that is similar to the line 220 in this example but that deviates from the line 220 to correspond to the actual traffic flow speeds from the data samples 230 (and other actual data samples for other road locations, not shown). Thus, line 225 between the actual data samples 230 may similarly correspond to traveling a distance of 0.8 miles in 2.5 minutes at a mean traffic speed of approximately 19 mph, but may have significant variations in speed during those 0.8 miles.

Accordingly, such expected traffic flow speed values 240 may provide significantly more accurate traffic speed estimates for particular road locations as contrasted with the values 235. For example, if another vehicle is planning on traveling on a route in the near future that includes a portion of the example Road X between the locations at distances 2.0 and 2.2 miles, planning information for such a route may significantly benefit by knowing that current expected values for actual traffic flow conditions for that 0.2 mile stretch of the road include an average speed of approximately 33 mph (as reflected by two of the values 240), rather than the overall average speed of 19 mph between the data samples 230, and in this case are generally consistent with the historical representative traffic flow conditions information values for that 0.2 mile stretch for the time period. Alternatively, if the vehicle that reported data samples 230 has only traveled to the 2.5 mile distance location or a short distance further (e.g., if the data sample 230*b* is received in a realtime or near-realtime manner), and if the estimated traffic flow conditions information 225 for locations beyond that 2.5 mile distance location are automatically determined by the estimated traffic information provider system in a realtime or near-realtime manner (e.g., within minutes or seconds), the estimated traffic flow conditions information 225 for those locations beyond that 2.5 mile distance location may be used to facilitate further travel of that vehicle on that road, such as update previous time estimates to arrive at particular locations, to suggest alternative routes if the estimated traffic flow conditions are significantly worse than normal, etc. For example, while the expected traffic flow speed values 240 are similar to the corresponding typical historical representative traffic flow conditions information values in this example, the current expected values for actual traffic flow conditions at one or more road locations may in other situations be determined to deviate significantly from typical historical representative traffic flow conditions information values for those road locations at a corresponding time period, such as to reflect current traffic that is unusual relative to historical averages, which may be similarly represented by determined expected traffic flow speed values for those road locations. It will be appreciated that determinations about estimated values for current actual travel flow conditions may further be beneficially made by combining information from multiple vehicles traveling on the road, such that actual traffic flow information from data samples from those vehicles and/or expected traffic flow values based on those data samples from those vehicles may be used.

FIG. 2B illustrates an example of road information for which travel profiles may be generated. In particular, FIG. 2B shows an exemplary map of a network of roads in the Seattle metropolitan geographical area of the state of Washington. As discussed in greater detail elsewhere, historical travel profiles may be generated and used for various types of roads in various embodiments and situations, including highways and/or non-highway roads, including arterial city streets and other local roads. For example, with respect to the map of FIG. 2B, a historical travel profile may be generated for at least a portion of the Interstate 90 highway and/or for at least a portion of the example R203 arterial city street.

With respect to the road Interstate 90 in the greater Seattle metro area, road link L1217 is a link 285 in this example that is part of Interstate 90 and has adjacent road links L1216 and L1218. In this example, road link 1217 is a bi-directional link that corresponds to both eastbound and westbound traffic, and thus is part of two road segments 290 and 295 that each correspond to one of the directions. In particular, example road segment S4860 corresponds to westbound traffic and includes the westbound traffic of link L1217 (as well as the westbound traffic of adjacent links L1216 and L1218), and example road segment S2830 corresponds to eastbound traffic and includes the eastbound traffic of link L1217 (as well as the eastbound traffic of nearby links L1218, L1219 and L1220). Road links and road segments may have various relationships in various embodiments, such as road link L1221 and road segment S4861 corresponding to the same portion of road, several road segments corresponding to multiple contiguous road links while road segment S4862 corresponds to non-contiguous road links L1227 and L1222. Thus, if historical representative traffic flow conditions information is being aggregated and determined for segment S4860, for example (e.g., as part of a historical travel profile for the portion of Interstate 90 that is illustrated in the map of FIG. 2B), the average speed for the entire road segment S4860 may be determined based on data for the road links L1216, L1217 and L1218. In addition, such historical representative traffic flow conditions information may be gathered based on fixed-location road sensors at particular road locations on those road links (not shown) and/or data samples gathered from vehicles (not shown) traveling along those road links. Furthermore, while various road links are of differing lengths in this example embodiment, in other embodiments the road links may all be the same length. In addition, road segments may include not only contiguous road links (such as road segments S4860, S4863, and S4864), but also non-contiguous road links. For example, road segment S4862 in FIG. 2B includes road links L1222 and L1227, despite the fact that the two road links are not contiguous. However, both links may have similar traffic flow characteristics so as to be grouped together in one road segment. Also, for ease of illustration, only one link and/or segment designator per physical road portion is shown; but each lane may be assigned one or more unique link and/or section designators. Similarly, each direction of traffic for a bi-directional road portion may be assigned one or more unique link and/or section designators.

With respect to the example R203 arterial city street (e.g., the Island Crest Way local road of the city of Mercer Island), it similarly is divided in this example into six contiguous road segments S201*a*-S201*f*, but does not have any illustrated road links (e.g., based on having road links that are not illustrated; based on not having any road links, such as being of a functional road classification for which map providers or others have not defined road links; etc.). In this example, the road R203 does not have any associated road sensors, and thus the historical representative traffic flow conditions information for the road R203 is gathered from data samples provided by vehicles (not shown) and/or users (not shown) who are traveling along the road R203. The historical representative traffic flow conditions information for the road R203 further have variability in this example amongst the six contiguous road segments S201*a*-S201*f* based on three structural traffic flow obstructions that are illustrated, as follows: the FO202*a* obstruction that is a traffic signal on segment S201*b*; the FO202*b* obstruction that is lane merging location on segment S201*c* where 4 traffic lanes north of the obstruction (2 lanes in each direction) merge to 3 traffic lanes south of the obstruction (1 lane is each direction and a center turn lane); and the FO202*c* obstruction that is a stop sign on segment S201*e*.

FIGS. 2C and 2D illustrate example historical travel profile information in a manner that is somewhat similar to that of FIG. 2A, but that correspond to the example road R203 discussed with respect to FIG. 2B. With respect to FIG. 2C, the x-axis of the displayed graph includes indications of the six road segments S201*a*-S201*f* of the example road that are illustrated in FIG. 2B, along with corresponding distances measured in this example from Interstate 90 progressing southward. However, rather than illustrating lines 220, 210 and 215 to illustrate typical, lower and upper information respectively for historical representative traffic flow conditions values as is illustrated in FIG. 2A, FIG. 2C instead illustrates a single typical historical representative traffic flow conditions value 255 for each segment, along with a value range 250 for each segment.

In addition, FIG. 2C illustrates information for two actual data samples 230*c* and 230*d* for a vehicle traveling along the road R203 during a time period Y that corresponds to a weekday during morning commute hours (e.g., a time period representing the days-of-week Monday through Thursday and the time range from 8 am-9 am), with the actual data samples in this example corresponding to locations on road segments S201*a* and S201*e*, respectively. FIG. 2C further illustrates expected traffic flow condition values 240 that have been automatically determined by an embodiment of an estimated traffic information provider system to represent an actual travel path of the vehicle along the intervening road segments S201*b*-S201*d* and for the following road segment S201*f*. As discussed with respect to FIG. 2A and elsewhere, the expected traffic flow condition values 240 are based on combining historical representative traffic flow information from the travel profile with the actual traffic flow information from the data samples 230.

In this example, however, actual traffic flow conditions are significantly better than historical typical representative traffic flow conditions for this time period (e.g., based on being a holiday, a school break, etc.), such as is reflected by actual data sample 230*d* having an actual traffic speed value that is well above the upper historical range for road segment S201*e* during this time period. Nonetheless, in some embodiments, the expected traffic flow condition values 240 may be generated based on the illustrated historical typical representative traffic flow conditions for this time period in a manner similar to that previously discussed, by fitting the actual traffic flow values for the vehicle to the illustrated historical representative traffic flow conditions values, despite two or more of the expected traffic flow condition values 240 being outside of the range of historical representative traffic flow conditions values for their corresponding road segment during this time period.

Alternatively, in some embodiments, the expected traffic flow condition values 240 may be generated based on using other historical representative traffic flow conditions information for the example road R203, such as by shifting the historical representative traffic flow conditions information to which the actual traffic flow values are fitted to another time period that better represents the actual traffic flow conditions on road R203 that produced the actual traffic flow values. For example, FIG. 2D illustrates information that is similar to that of FIG. 2C, but corresponds to a later time period after historical commute traffic has ended for example road R203 (e.g., a time period representing the days-of-week Monday through Thursday and the time range from 10 am-11 am). As would be intuitively expected, the historical typical representative traffic flow conditions information 255 and corresponding ranges 250*b* in FIG. 2D for the later time period have higher values for at least some of the road segments, although the representative traffic flow conditions information for some road segments may change less than others (e.g., for road segments S201*a* and S201*f*, neither of which have corresponding flow obstructions in this example). Thus, while the expected traffic flow condition values 240 in FIG. 2D have not changed relative to those of FIG. 2C, it can be visually determined that they better match the historical representative traffic flow conditions information illustrated in FIG. 2D than the historical representative traffic flow conditions information illustrated in FIG. 2C. Such matching and determination may be made in various manners, including based on mathematical weighting and curve fitting, as discussed in greater detail elsewhere. In addition, while not illustrated here, in some embodiments the matching of actual traffic flow values to historical representative traffic flow conditions information may be made with respect to shifting space or location (e.g., by treating actual data sample 230*d* of FIG. 2C as being shifted to the right on the graph and being part of example road segment S201*f* of FIG. 2C, optionally with a corresponding shift for actual data sample 230*c*), whether instead of or in addition to shifting time periods.

It will be appreciated that the details of FIGS. 2A-2D are provided for illustrative purposes, and that the described inventive techniques are not limited to these details.

FIG. 1 is a block diagram illustrating an embodiment of a server computing system 100 that is suitable for performing at least some of the described techniques, such as by executing an embodiment of an Expected Traffic Information Provider system. The example server computing system 100 includes a central processing unit ("CPU") 135, various input/output ("I/O") components 105, storage 140, and memory 145. Illustrated I/O components include a display 110, a network connection 115, a computer-readable media drive 120, and other I/O devices 130 (e.g., keyboards, mice or other pointing devices, microphones, speakers, etc.).

In the illustrated embodiment, an Expected Traffic Information Provider system 150 is executing in memory 145, as is an optional Route Selector system 160 and optional other systems provided by programs 162 (e.g., a predictive traffic forecasting program based at least in part on historical traffic data, a realtime traffic information provider system to provide traffic information to clients in a realtime or near-realtime manner, etc.), with these various executing systems generally referred to herein as traffic analysis systems, and with the system 150 including various software instructions in some embodiments that when executed program the CPU 135 to provide the described functionality. The server computing system and its executing traffic analysis systems may communicate with other computing systems, such as various client devices 182, vehicle-based clients and/or data sources 184, road traffic sensors 186, other data sources 188, and third-party computing systems 190, via network 180 (e.g., the Internet, one or more cellular telephone networks, etc.) and wireless communication link 185.

The client devices 182 may take various forms in various embodiments, and may generally include any communication devices and other computing devices capable of making requests to and/or receiving information from the traffic analysis systems. In some cases, the client devices 182 may include mobile devices that travel on particular roads (e.g., handheld cell phones or other mobile devices with GPS capabilities or other location determination capabilities that are carried by users traveling in vehicles, such as operators and/or passengers of the vehicles), and if so, such client devices may act as mobile data sources that provide current traffic data based on current travel on the roads (e.g., if the users of the client devices are on the roads). In addition, in some situations the client devices may run interactive console applications (e.g., Web browsers) that users may utilize to make requests for generated expected traffic-related information based on historical traffic information, while in other cases at least some such generated expected traffic-related information may be automatically sent to the client devices (e.g., as text messages, new Web pages, specialized program data updates, etc.) from one or more of the traffic analysis systems.

The vehicle-based clients/data sources 184 in this example may each include a computing system located within a vehicle that provides data to one or more of the traffic analysis systems and/or that receives data from one or more of those systems. In some embodiments, the historical information used by the Expected Traffic Information Provider system may originate at least in part from a distributed network of vehicle-based data sources that provide information related to current traffic conditions. For example, each vehicle may include a GPS ("Global Positioning System") device (e.g., a cellular telephone with GPS capabilities, a stand-alone GPS device, etc.) and/or other geo-location device capable of determining the geographic location, speed, direction, and/or other data related to the vehicle's travel. One or more devices on or in the vehicle (whether the geo-location device(s) or a distinct communication device) may occasionally gather such data and provide it to one or more of the traffic analysis systems (e.g., by way of a wireless link). For example, a system provided by one of the other programs 162 may obtain and use current road traffic conditions information in various ways), and such information (whether as originally obtained or after being processed) may later be used by the Expected Traffic Information Provider system as historical data. Such vehicles may include a distributed network of individual users, fleets of vehicles (e.g., for delivery companies, transportation companies, governmental bodies or agencies, vehicles of a vehicle rental service, etc.), vehicles that belong to commercial networks providing related information (e.g., the OnStar service), a group of vehicles operated in order to obtain such traffic conditions information (e.g., by traveling over predefined routes, or by traveling over roads as dynamically directed, such as to obtain information about roads of interest), etc. In addition, such vehicle-based information may be generated in other manners in other embodiments, such as by cellular telephone networks, other wireless networks (e.g., a network of Wi-Fi hotspots) and/or other external systems (e.g., detectors of vehicle transponders using RFID or other communication techniques, camera systems that can observe and identify license plates and/or users' faces) that can detect and track information about vehicles passing by each of multiple transmitters/receivers in the network.

The road traffic sensors 186 include multiple sensors that are installed in, at, or near various streets, highways, or other roadways, such as for one or more geographic areas. These sensors include loop sensors that are capable of measuring the number of vehicles passing above the sensor per unit time, vehicle speed, and/or other data related to traffic conditions. In addition, such sensors may include cameras, motion sensors, radar ranging devices, and other types of sensors that are located adjacent to a roadway. The road traffic sensors 186 may periodically or continuously provide measured data via wire-based or wireless-based data link to one or more of the traffic analysis systems via the network 180 using one or more data exchange mechanisms (e.g., push, pull, polling, request-response, peer-to-peer, etc.). For example, a system provided by one of the other programs 162 may obtain and use current road traffic conditions information in various ways, and that such information (whether as originally obtained or after being processed) may later be used as historical information by the Expected Traffic Information Provider system. In addition, while not illustrated here, in some embodiments one or more aggregators of such road traffic sensor information (e.g., a governmental transportation body that operates the sensors, a private company that generates and/or aggregates data, etc.) may instead obtain the traffic data and make that data available to one or more of the traffic analysis systems (whether in raw form or after it is processed). In some embodiments, the traffic data may further be made available in bulk to the traffic analysis systems.

The other data sources 188 include a variety of types of other sources of data that may be utilized by one or more of the traffic analysis systems to generate expected traffic conditions information. Such data sources include, but are not limited to, holiday and season schedules or other information used to determine how to group and categorize historical data for specific days and times, schedule information for non-periodic events, schedule information related to traffic sessions, schedule information for planned road construction and other road work, etc.

Third-party computing systems 190 include one or more optional computing systems that are operated by parties other than the operator(s) of the traffic analysis systems, such as parties who provide current and/or historical traffic data to the traffic analysis systems, and parties who receive and make use of traffic-related data provided by one or more of the traffic analysis systems. For example, the third-party computing systems may be map vendor systems that provide data (e.g., in bulk) to the traffic analysis systems. In some embodiments, data from third-party computing systems may be weighted differently than data from other sources. Such weighting may indicate, for example, how many measurements participated in each data point. Other third-party computing systems may receive generated expected traffic-related information from one or more of the traffic analysis systems and then provide related information (whether the received information or other information based on the received information) to users or others (e.g., via Web portals or subscription services). Alternatively, the third-party computing systems 190 may be operated by other types of parties, such as media organizations that gather and report such traffic-related information to their consumers, or online map companies that provide such traffic-related information to their users as part of travel-planning services.

In the illustrated embodiment of FIG. 1, the Expected Traffic Information Provider system 150 includes a Historical Data Manager module 152, a Current Data Manager module 154, a Current Traffic Condition Estimator module 156, and an Information Supplier module 158, with one or more of the modules 152, 154, 156 and 158 each including various software instructions in some embodiments that when executed program the CPU 135 to provide the described functionality.

The Expected Traffic Information Provider system obtains historical traffic data from one or more of various sources, and stores the historical data in a database 142 on storage 140 in this example. As previously discussed, the historical data may include data in a raw form as originally previously received from one or more external sources, or may instead be obtained and stored in a processed form. For example, for each of one or more traffic conditions measures of interest, the historical data may include values for that measure for some or all road segments and/or road links for each of a variety of prior time periods. They historical traffic data may have originally been generated by one or more external sources, such as vehicle-based data sources 184, road traffic sensors 186, other data sources 188, and/or third-party computing systems 190, and in some embodiments may alternatively be stored by one or more such sources and currently provided to the Expected Traffic Information Provider system from such storage. In some embodiments, the system 150 or other system may further detect and/or correct various errors in the historical data (e.g., due to sensor outages and/or malfunctions, network outages, data provider outages, etc.), such as if the obtained data is raw historical data that was not previously processed. For example, data may be filtered and/or weighted in various ways to remove or deemphasize data from consideration if it is inaccurate or otherwise unrepresentative of historical traffic conditions of interest, including by identifying data samples that are not of interest based at least in part on roads with which the data samples are associated and/or data samples that are statistical outliers with respect to other data samples. In some embodiments, the filtering may further include associating the data samples with particular roads, road segments, and/or road links. The data filtering may further exclude data samples that otherwise reflect vehicle locations or activities that are not of interest (e.g., parked vehicles, vehicles circling in a parking lot or structure, etc.) and/or data samples that are otherwise unrepresentative of vehicle travel on roads of interest. In some embodiments, the system 150 or other system may also optionally aggregate obtained data from a variety of data sources, and may further perform one or more of a variety of activities to prepare data for use, such as to place the data in a uniform format; to discretize continuous data, such as to map real-valued numbers to enumerated possible values; to sub-sample discrete data; to group related data (e.g., a sequence of multiple traffic sensors located along a single segment of road that are aggregated in an indicated manner); etc.

After obtaining and optionally processing the historical traffic data, a Historical Data Manager module 152 of the Expected Traffic Information Provider system then analyzes the historical data for use in generating expected traffic conditions information for one or more of various measures, such as for use in one or more travel/road profiles being generated. The module 152 or other module may, for example, analyze the historical traffic data to generate average traffic flow conditions information for one or more measures of traffic conditions. The measures may include, for example, average vehicle speed; volume of traffic for an indicated period of time; average occupancy time of one or more traffic sensors, etc. The generated average traffic conditions information may then be stored for later use, such as in the database 142. The module 152 may further perform other activities to enable the generation of expected traffic conditions information, such as by using the historical traffic information to generate one or more travel/road profile grids or other travel/road profiles. Such generated travel/road profile information may also be stored for later use as part of the historical data in database 142, or instead in other manners in other embodiments.

The Expected Traffic Information Provider system 150 may also obtain recent traffic probe data or other recent traffic information in various manners, such as under control of a Current Data Manager module 154 of the system 150. The module 154 may, for example, initiate interactions 195 with particular vehicle-based data sources 184 and/or mobile client devices 182 to gather such information, or such data sources 184 and client devices 182 may instead forward such information to the module 154 (e.g., periodically). As previously noted, such communications may include wireless links 185 in some embodiments and situations. Such recent traffic information may, for example, be stored in the database 143 on storage 140, or instead in other manners in other embodiments. The module 154 may further perform other activities to enable the use of current or recent traffic conditions information, such as by combining multiple probe data samples or other pieces of traffic flow conditions information for a particular vehicle for use in representing at least some of an actual travel path of the vehicle. Such information about actual travel paths of one or more vehicles may also be stored for later use as part of the current data in database 143, or instead in other manners in other embodiments.

After the historical traffic information and recent traffic information is available, the Current Traffic Condition Estimator module 156 of the system 150 may combine and analyze that information in various ways, such as to fit actual travel paths of particular vehicles/devices to portions of particular corresponding travel/road profiles, and to generate expected traffic conditions information for portions of the actual travel paths based on the fitting. The generated expected traffic conditions information for the one or more actual travel paths may then be stored in the database 144 on storage 140, for example, or instead stored in other manners in other embodiments. The generated expected traffic conditions information for the actual travel path of one or more vehicles on a road portion may also be used in various ways, such as to adjust historical representative traffic flow condition information from a generated travel/road profile for the road portion to reflect current or recent changes in the actual traffic flow based at least in part on the generated expected traffic conditions information (e.g., for use in providing the adjusted traffic flow information to facilitate future travel of vehicles over the road portion), and/or in other manners, such as to be provided to the optional Route Selector system, client devices 182, vehicle-based clients 184, third-party computing systems, and/or other users in at least some embodiments. Such generated expected traffic conditions information may also be stored for later use in database 144, or instead in other manners in other embodiments.

In addition, after expected traffic flow conditions information has been generated for one or more traffic conditions measures for the actual travel path of one or more vehicles on a road portion, and optionally used in one or more manners (e.g., to adjust historical representative traffic flow condition information from a generated travel/road profile for the road portion to reflect current or recent changes in the actual traffic flow based at least in part on the generated expected traffic conditions information), the Information Supplier module 158 of the system 150 may provide corresponding information to various clients, such as based on current or previously supplied requests. For example, the Route Selector system 160 may optionally determine travel route information for one or more vehicles based at least in part on the expected traffic flow conditions information, such as based on projected average speed or other traffic conditions projected to currently occur based on that expected traffic conditions information, and may provide such route information to others in various ways. In addition, in some embodiments, the generated expected traffic conditions information may be used as one type of input to a system that predicts and/or forecasts future traffic conditions information based on current conditions, such as by using the expected traffic conditions information to project current conditions (e.g., if the current condition information is not available at the time of prediction, or by using the expected traffic conditions information at an earlier time to perform the prediction or forecast in advance).

It will be appreciated that the illustrated computing systems are merely illustrative and are not intended to limit the scope of the present invention. For example, computing system 100 may be connected to other devices that are not illustrated, including through one or more networks such as the Internet or via the Web. More generally, a "client" or "server" computing system or device, or traffic analysis system and/or module, may comprise any combination of hardware or software that can interact and perform the described types of functionality, including without limitation desktop or other computers, database servers, network storage devices and other network devices, PDAs, cellphones, wireless phones, pagers, electronic organizers, Internet appliances, television-based systems (e.g., using set-top boxes and/or personal/digital video recorders), and various other consumer products that include appropriate inter-communication capabilities. In addition, the functionality provided by the illustrated system modules may in some embodiments be combined in fewer modules or distributed in additional modules. Similarly, in some embodiments the functionality of some of the illustrated modules may not be provided and/or other additional functionality may be available. Furthermore, while the Expected Traffic Information Provider system 150 and its exemplary modules 152-158 are illustrated in this example as being part of one or more programmed computing systems that are remote from the various exemplary vehicles 184, in other embodiments some or all of the Expected Traffic Information Provider system 150 (e.g., one or more of the modules 152-158) may instead execute as part of one or more computing devices that are part of or otherwise traveling with one or more of the vehicles 184, and may optionally communicate some or all generated, calculated or determined information to other remote parts of the system 150 (e.g., other of the modules 152-158).

It will also be appreciated that, while various items are illustrated as being stored in memory or on storage while being used, these items or portions of them may be transferred between memory and other storage devices for purposes of memory management and/or data integrity. Alternatively, in other embodiments some or all of the software modules and/or systems may execute in memory on another device and communicate with the illustrated computing system/device via inter-computer communication. Furthermore, in some embodiments, some or all of the modules may be implemented or provided in other manners, such as at least partially in firmware and/or hardware, including, but not limited to, one or more application-specific integrated circuits (ASICs), standard integrated circuits, controllers (e.g., by executing appropriate instructions, and including microcontrollers and/or embedded controllers), field-programmable gate arrays (FPGAs), complex programmable logic devices (CPLDs), etc. Some or all of the system modules or data structures may also be stored (e.g., as software instructions or structured data) on a non-transitory computer-readable storage medium, such as a hard disk, a memory, a network, or a portable media article to be read by an appropriate drive or via an appropriate connection. The system modules and data structures may also be transmitted as generated data signals (e.g., as part of a carrier wave or other analog or digital propagated signal) on a variety of computer-readable transmission mediums, including wireless-based and wired/cable-based mediums, and can take a variety of forms (e.g., as part of a single or multiplexed analog signal, or as multiple discrete digital packets or frames). Such computer program products may also take other forms in other embodiments. Accordingly, the present invention may be practiced with other computer system configurations.

Figure 3:
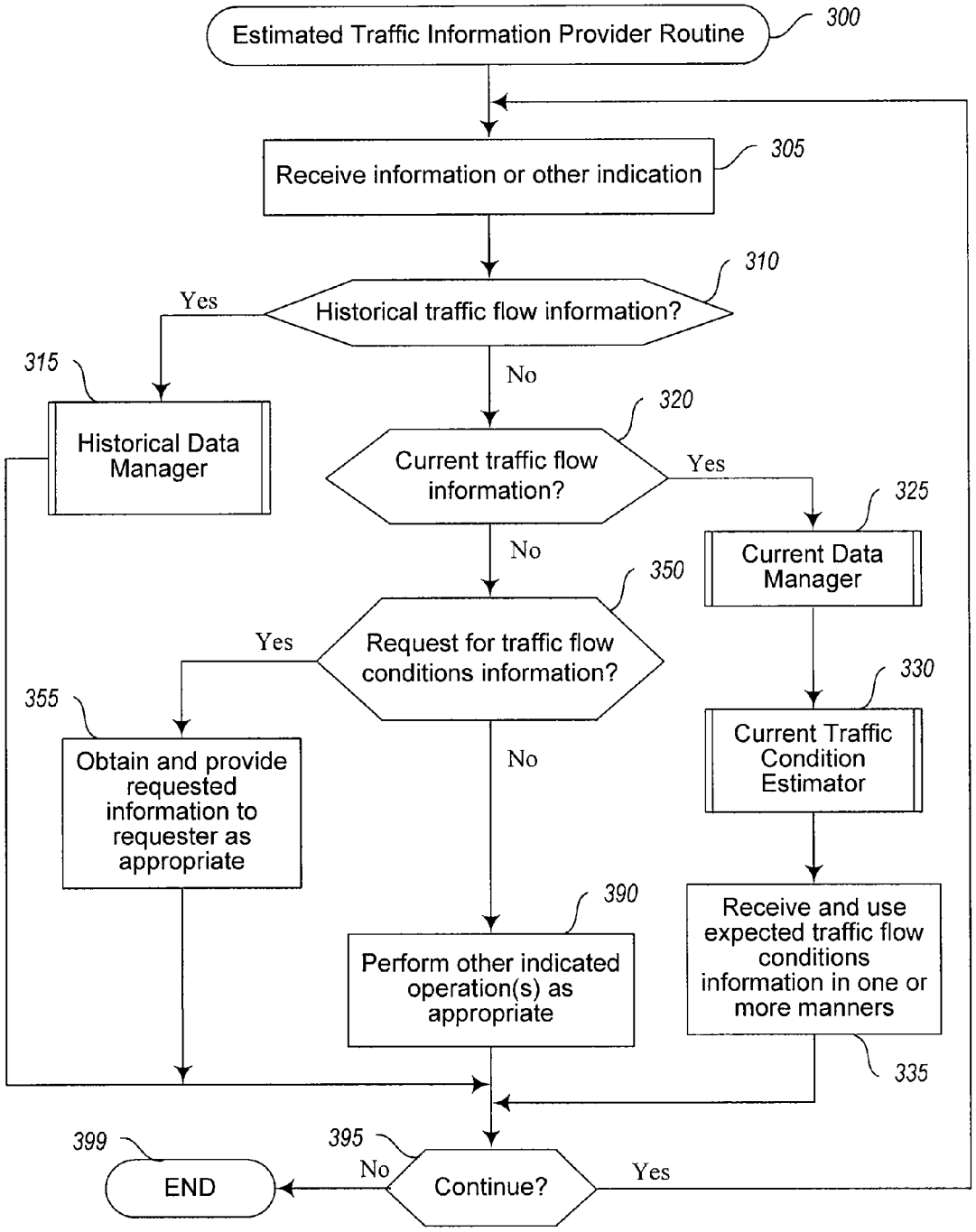
FIG. 3 is a flow diagram of an example embodiment of an Estimated Traffic Information Provider routine.

FIG. 3 is a flow diagram of an example embodiment of an Estimated Traffic Information Provider routine 300. The routine may be provided by, for example, execution of the Estimated Traffic Information Provider system 150 of FIG. 1, such as to generate expected traffic flow conditions information for vehicles' travel paths by combining historical and current information about road traffic flow conditions.

The illustrated embodiment of the routine 300 begins at block 305, where information or another indication is received. The routine continues to block 310 to determine whether information is received in block 305 that may be used as historical traffic flow conditions information for one or more roads. If so, the routine continues to block 315 to execute a Historical Data Manager routine to analyze the historical traffic flow conditions information, such as to optionally generate or update one or more historical travel profiles for one or more road portions, with one example embodiment of such a routine being further described with respect to FIG. 4.

If it is instead determined in block 310 that the information received in block 305 is not historical traffic flow information, the routine continues to block 320 to determine whether information is received in block 305 that reflects recent or otherwise current traffic flow information for one or more roads. If so, the routine continues to block 325 to execute a Current Data Manager routine to analyze the current traffic flow information, such as to construct representations of travel paths of one or more vehicles using partial actual traffic flow information for the vehicles (e.g., using multiple periodic data samples reported by devices associated with the vehicles), with one example embodiment of such a routine being further described with respect to FIG. 5. After block 325, the routine continues to block 330 to execute a Current Traffic Condition Estimator routine to determine expected traffic flow conditions information for one or more vehicles, such as based on fitting travel path representations that are constructed by and received from block 325 to corresponding historical travel profiles previously generated with respect to block 315, with one example embodiment of such a routine being further described with respect to FIG. 6.

After block 330, the routine continues to block 335 to optionally receive and use expected traffic flow conditions information from block 330, such as to perform one or more of the following: updating typical historical traffic flow conditions information for one or more road portions to reflect current traffic flow conditions information that are different from the typical historical traffic flow conditions information; providing information to various vehicles or users that will be traveling on the one or more road portions in the future to indicate the updated typical traffic flow conditions information or other otherwise indicate particular expected traffic flow conditions information received from block 330; providing information to vehicles or users that are currently traveling on the one or more road portions (e.g., vehicles or users from whom the current traffic flow conditions information is received or to whom the current traffic flow conditions information otherwise corresponds) to facilitate further travel by those vehicles/users on part of those road portions; etc. In addition, in the illustrated embodiment, such expected traffic flow conditions information may further be used in other manners, such as to be provided to requesters with respect to block 355 or otherwise be used in block 390.

If it is instead determined in block 320 that the information received in block 305 is not current traffic flow information, the routine continues to block 350 to determine whether a request is received in block 305 for one or more types of traffic flow conditions information, such as from particular vehicles and/or users, from one or more other traffic analysis systems that use information from the estimated traffic information provider system to provide additional functionality to clients, etc. If so, the routine continues to block 355 to retrieve and provide the requested information to the requester as appropriate, such as after optionally determining that the requester is authorized to receive the information (e.g., is an authorized partner or affiliate, has paid corresponding fees to enable access to the requested information, etc.). The types of information that may be requested and provided may have various forms in various embodiments, including any data that is used by and/or produced by any of the blocks 315, 325, 330 and 335. In addition, in some embodiments the functionality of block 355 may be provided as part of an information supplier module of the estimated traffic information provider system, as discussed in greater detail with respect to module 158 of system 150 of FIG. 1.

If it is instead determined in block 350 that a request was not received in block 305 for desired traffic flow information, the routine continues to block 390 to perform one or more other operations as appropriate. Such other operations may have various forms in various embodiments, including receiving and storing information for later use (e.g., information about particular roads, about particular traffic flow obstructions, etc.), performing account-related activities for users or other systems that have accounts with the estimated traffic information provider system or that are otherwise affiliated with the estimated traffic information provider system (e.g., registering new users/affiliates, obtaining payment-related information from users/affiliates for fee-based functionality of the estimated traffic information provider system, initiating payment collection activities or other activities related to obtain payment from users/affiliates for past and/or planned future activities that have associated fees, etc.), performing occasional housekeeping operations, etc.

After steps 315, 335, 355 or 390, the routine continues to step 395 to determine whether to continue, such as until an explicit instruction to terminate is received. If so, the routine returns to step 305, and if not continues to step 399 and ends.

Figure 4:
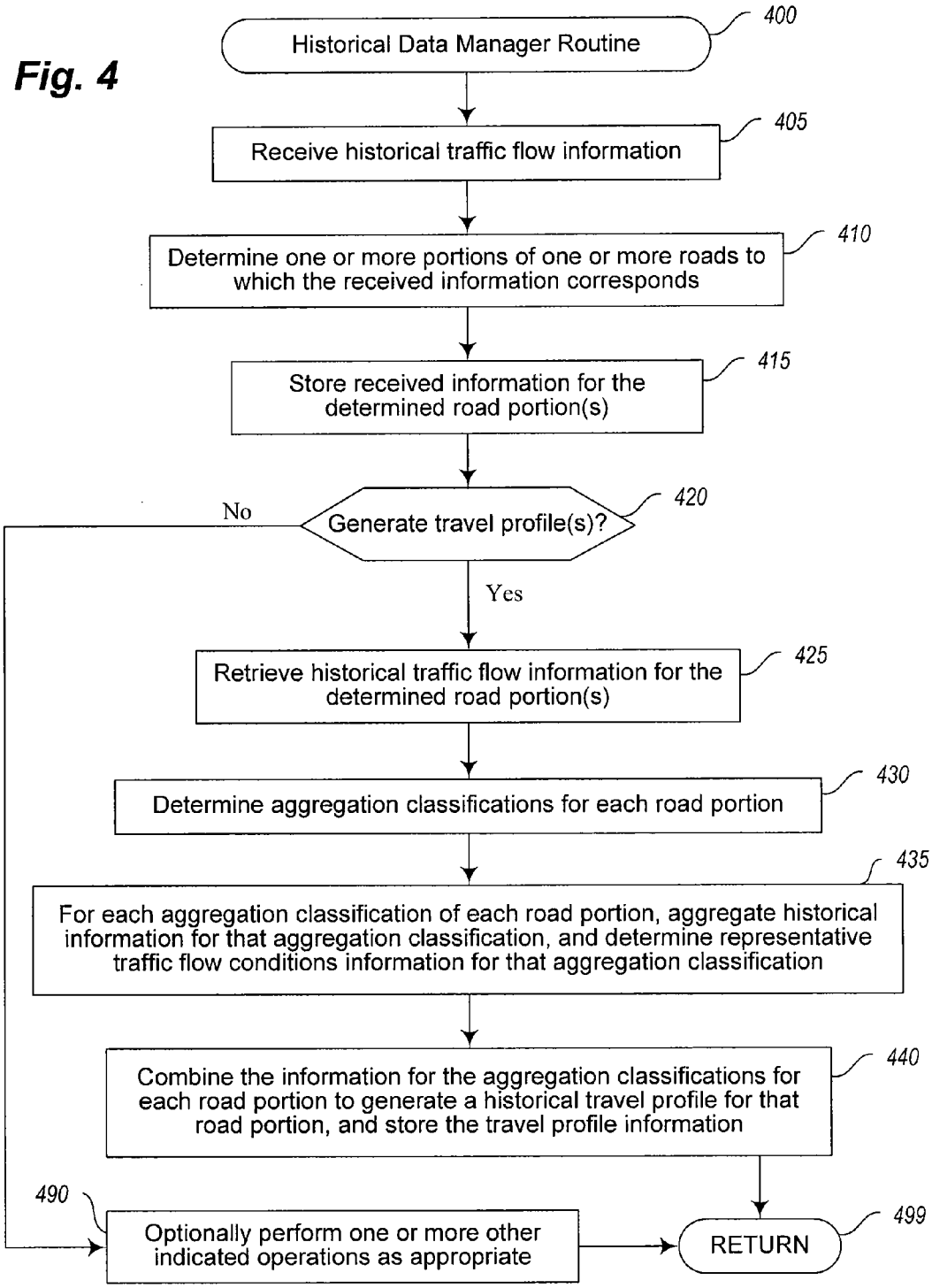
FIG. 4 is a flow diagram of an example embodiment of a Historical Data Manager routine.

FIG. 4 is a flow diagram of an example embodiment of a Historical Data Manager routine 400. The routine may be provided by, for example, execution of the Historical Data Manager module 152 of FIG. 1, such as to analyze and use historical traffic flow information in various manners, including to optionally generate or update one or more historical travel profiles for one or more road portions. In some situations, the routine 400 may be invoked from the routine 300 illustrated in FIG. 3, such as with respect to block 315.

The illustrated embodiment of the routine 400 begins at block 405, where information is received that may be used as historical traffic flow conditions information for one or more roads. Such historical traffic flow conditions information may have various forms in various embodiments and situations, as discussed in greater detail elsewhere, including data readings from fixed-location road sensors associated with the one or more roads and/or data samples from devices associated with vehicles and/or users that are traveling on the one or more roads. The routine then continues to block 410 to determine the one or more road portions with which the information is associated (e.g., based on GPS-based locations or other location information that is associated with particular pieces of the historical traffic flow conditions information), and in block 415 stores the received historical information in a manner that is associated with the corresponding determined road portions.

In block 420, the routine then determines whether to generate one or more travel profiles at the current time, such as for at least one of the determined road portions based on the information received in block 405 (e.g., in response to having sufficient data to do such generation for the determined road portions, in response to a corresponding instruction received in block 405 with the historical information, on a periodic basis, etc.). If so, the routine continues to block 425 to retrieve the stored or otherwise available historical traffic flow conditions information for the determined road portion(s), and in block 430 determines aggregation classifications to use for each such determined road portion. As discussed in greater detail elsewhere, the aggregation classifications may in some embodiments be based at least in part on distinct locations on a determined road portion and/or distinct time periods, such as with each aggregation classification having a distinct combination of one or more road locations and at least one time period. Particular road locations and/or time periods to use may be determined and/or modified in at least some embodiments, as discussed in greater detail elsewhere, including in some embodiments based on availability or lack of availability of particular historical information, such as to merge two or more predefined road location groups (e.g., road links) and/or merge two or more predefined time periods, or to separate a single predefined road location group into multiple such groups and/or separate a single predefined time period into multiple such time periods.

After block 430, the routine continues to block 435 to, for each aggregation classification of each road portion being analyzed, aggregate historical traffic flow conditions information that corresponds to that aggregation classification, and determine representative traffic flow conditions information that is typical for that aggregation classification (e.g., for the time period of the aggregation classification at those one or more road locations of the determined road portion). For example, in some embodiments, an average traffic speed may be determined for each aggregation classification, optionally with various error estimates or other variability indications, as discussed in greater detail elsewhere. In block 440, the routine then combines the information from the various aggregation classifications for each of the determined road portion(s) to generate a historical travel profile for that road portion, and stores the generated travel profile for later use.

If it is instead determined in block 420 to not generate one or more travel profiles at the current time, the routine continues to block 490 to optionally perform one or more other indicated operations as appropriate. Such other operations may have various forms in various embodiments, including receiving and storing information for later use (e.g., information about particular roads, about particular time periods and/or road location groups, etc.), updating previously generated travel profiles (e.g., based on new historical traffic flow conditions information received in block 405), etc. After steps 440 or 490, the routine continues to step 495 and returns.

Figure 5:
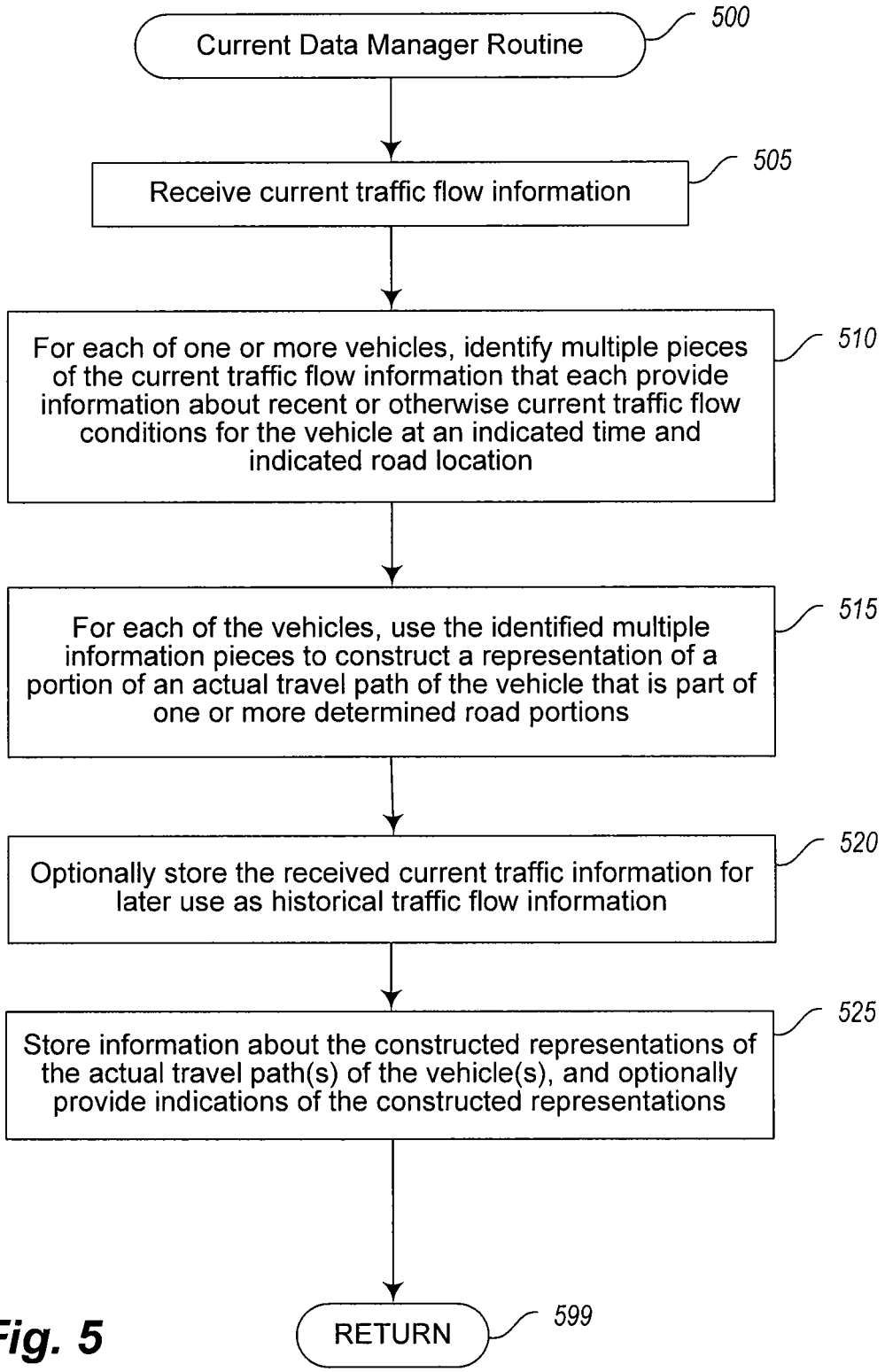
FIG. 5 is a flow diagram of an example embodiment of a Current Data Manager routine.

FIG. 5 is a flow diagram of an example embodiment of a Current Data Manager routine 500. The routine may be provided by, for example, execution of the Current Data Manager module 154 of FIG. 1, such as to combine multiple probe data samples or other pieces of traffic flow conditions information for a particular vehicle for use in representing at least some of an actual travel path of the vehicle. In some situations, the routine 500 may be invoked from the routine 300 illustrated in FIG. 3, such as with respect to block 325.

The illustrated embodiment of the routine 500 begins at block 505, where current traffic flow conditions information is received for one or more roads and one or more vehicles. Such current traffic flow conditions information may have various forms in various embodiments and situations, as discussed in greater detail elsewhere, including data samples from devices associated with the vehicles and/or users in the vehicles that are traveling on the one or more roads. The routine then continues to block 510 to, for each of one or more of the vehicles, identify data samples or other pieces of information in the current traffic flow conditions information that are associated with the vehicle, such as to provide partial actual traffic flow conditions information for the vehicle at one or more indicated times and at one or more indicated road locations. In block 515, the routine then uses the identified information pieces for each of the vehicles to construct a representation of a portion of an actual travel path of the vehicle alone or more road portions on which the vehicle recently traveled or is currently traveling, such as by ordering the information pieces by associated time and/or in other manners, and optionally performing additional processing on some or all of the information pieces (e.g., identifying any occurrences of vehicle speed below a defined speed threshold for at least a defined time threshold).

After block 515, the routine continues to block 520 to optionally store the current traffic flow conditions information received in block 505 for later use, such as use as historical traffic flow conditions information at a later time. In block 525, the routine then stores information about the travel profile representations constructed in block 515, and optionally provides indications of one or more of those constructed travel profile representations. The routine then continues to block 599 and returns. While not illustrated here, the routine may further optionally perform other indicated operations as appropriate in some embodiments and at some times, such as to receive and store information for later use (e.g., information about particular roads, about particular speed thresholds and/or time thresholds for use in constructing travel profile representations, etc.), updating previously constructed travel profile representations (e.g., based on new corresponding current traffic flow conditions information received in block 505), etc.

Figure 6:
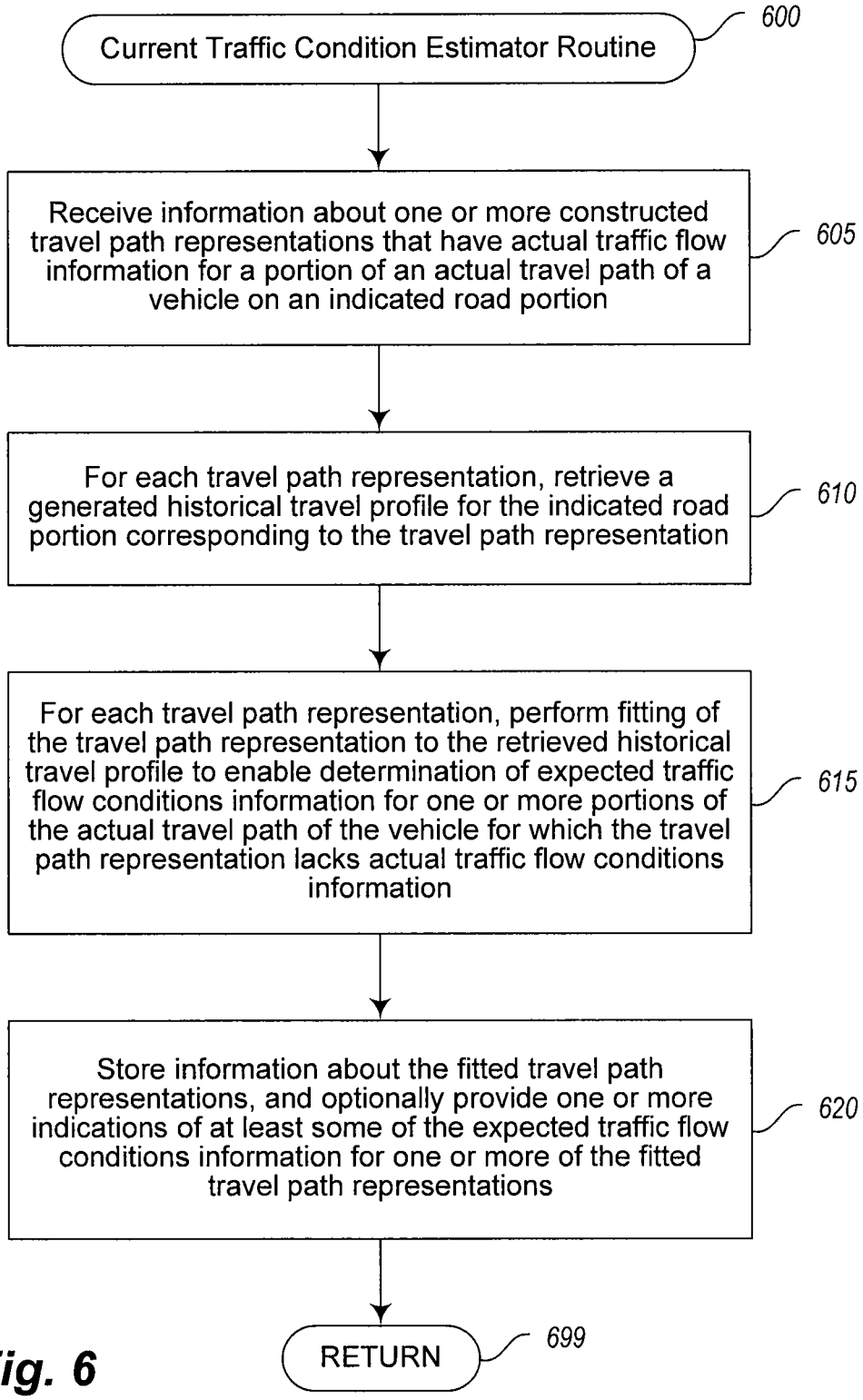
FIG. 6 is a flow diagram of an example embodiment of a Current Traffic Condition Estimator routine.

FIG. 6 is a flow diagram of an example embodiment of a Current Traffic Condition Estimator routine 600. The routine may be provided by, for example, execution of the Current Traffic Condition Estimator module 156 of FIG. 1, such as to fit actual travel paths of particular vehicles/devices to portions of particular corresponding travel profiles, and to generate expected traffic conditions information for portions of the actual travel paths based on the fitting. In some situations, the routine 600 may be invoked from the routine 300 illustrated in FIG. 3, such as with respect to block 330.

The illustrated embodiment of the routine 600 begins at block 605, where information is received that includes one or more constructed travel path representations for one or more vehicles to reflect actual travel paths of the vehicle(s) on one or more roads, which in this case are received from the output of block 325. Such constructed travel path representations include actual traffic flow conditions information for part of the corresponding actual travel paths, as discussed in greater detail elsewhere. The routine then continues to block 610 to, for each constructed travel path representation, retrieve at least one generated historical travel profile for a road portion to which the constructed travel path representation corresponds, such as may be previously generated with respect to block 315 of FIG. 3, or instead dynamically generated in some embodiments.

After block 610, the routine continues to block 615 to, for each constructed travel path representation, perform activities to fit the constructed travel path representation to the corresponding retrieved historical travel profile(s), such as by matching actual traffic flow conditions information from the constructed travel path representation to corresponding representative traffic flow conditions information for corresponding aggregation classifications of the constructed travel path representation, and by determining expected traffic flow conditions information for other parts of the constructed travel path representation for which actual traffic flow conditions information is not available, in light of the differing representative traffic flow conditions information for corresponding aggregation classifications of the constructed travel path representation. Additional details are provided elsewhere related to such determining of expected traffic flow conditions information corresponding to an actual travel path of a vehicle, such as based on the fitting of such actual travel path information to a generated historical travel profile.

In block 620, the routine then stores information about the determined expected traffic flow conditions information for the constructed travel path representation(s), and optionally more generally stores information corresponding to the fitting of such actual travel path information from the constructed travel path representation(s) to the historical travel profile(s). The routine further optionally provides indications of at least some of the expected traffic flow conditions information for the constructed travel path representation(s), and then continues to block 599 and returns. While not illustrated here, the routine may further optionally perform other indicated operations as appropriate in some embodiments and at some times, such as to receive and store information for later use (e.g., information about particular information for use in fitting activities), updating information from previous fittings (e.g., based on new information received in block 605), etc.

Additional details related to filtering, conditioning, and aggregating information about road conditions and to generating expected traffic information that is predicted, forecast and expected are available in pending U.S. patent application Ser. No. 11/473,861, filed Jun. 22, 2006 and entitled "Obtaining Road Traffic Condition Data From Mobile Data Sources;" in pending U.S. application Ser. No. 11/367,463, filed Mar. 3, 2006 and entitled "Dynamic Time Series Prediction of Future Traffic Conditions;" and in pending U.S. application Ser. No. 11/835,357, filed Aug. 7, 2007 and entitled "Representative Road Traffic Flow Information Based On Historical Data;" each of which is hereby incorporated by reference in its entirety.

It will also be appreciated that in some embodiments the functionality provided by the routines discussed above may be provided in alternative ways, such as being split among more routines or consolidated into fewer routines. Similarly, in some embodiments illustrated routines may provide more or less functionality than is described, such as when other illustrated routines instead lack or include such functionality respectively, or when the amount of functionality that is provided is altered. In addition, while various operations may be illustrated as being performed in a particular manner (e.g., in serial or in parallel) and/or in a particular order, those skilled in the art will appreciate that in other embodiments the operations may be performed in other orders and in other manners. Those skilled in the art will also appreciate that the data structures discussed above may be structured in different manners, such as by having a single data structure split into multiple data structures or by having multiple data structures consolidated into a single data structure. Similarly, in some embodiments illustrated data structures may store more or less information than is described, such as when other illustrated data structures instead lack or include such information respectively, or when the amount or types of information that is stored is altered.

From the foregoing it will be appreciated that, although specific embodiments have been described herein for purposes of illustration, various modifications may be made without deviating from the spirit and scope of the invention. Accordingly, the invention is not limited except as by the appended claims and the elements recited therein. In addition, while certain aspects of the invention may be presented in certain claim forms, the inventors contemplate the various aspects of the invention in any available claim form. For example, while only some aspects of the invention may be recited as being embodied in a computer-readable medium at particular times, other aspects may likewise be so embodied.

What is claimed is:

1. A computer-implemented method comprising:

receiving information about prior road traffic flow conditions at multiple prior times for an indicated portion of a road having a plurality of locations, the indicated portion of the road having one or more traffic flow obstructions at one or more of the plurality of locations that reduce traffic flow at those one or more locations;

automatically generating, by one or more programmed computing systems, a historical travel profile of the indicated portion of the road based at least in part on the received information about the prior road traffic flow conditions, the generated historical travel profile indicating differing representative traffic flow conditions for a plurality of distinct combinations of the plurality of locations and of multiple time periods;

obtaining information about an actual travel path of a vehicle that previously passed by the plurality of locations of the indicated portion of the road, the obtained information indicating actual traffic flow conditions of the vehicle at a subset of two or more of the plurality of locations of the indicated portion of the road and not indicating actual traffic flow conditions of the vehicle at other locations of the plurality of locations, wherein the other locations include locations between the two or more locations of the subset that the vehicle passed by without a device associated with the vehicle generating a corresponding data sample;

automatically calculating, by at least one of the programmed computing systems, expected traffic flow conditions of the vehicle as it previously passed the other by fitting the actual travel path of the vehicle to the representative traffic flow conditions indicated by the generated historical travel profile; and providing one or more indications of the automatically calculated expected traffic flow conditions of the vehicle.

2. The method of claim 1 wherein the indicated portion of the road includes a series of multiple defined road links, wherein the received information about the prior road traffic flow conditions includes a plurality of readings from multiple road traffic sensors that each has a location associated with one of the road links, and wherein each of the readings reports an average speed of traffic on the associated road link for one of the road traffic sensors at one of the prior times.

3. The method of claim 2 wherein the obtained information about the actual travel path of the vehicle includes a plurality of data samples that each reports an actual traffic speed of the vehicle at an indicated time and at an indicated associated road location, the data samples being periodically generated by the device associated with the vehicle, and wherein the indicated associated road locations for the plurality of data samples include the two or more locations of the subset.

4. The method of claim 1 wherein the received information about the prior road traffic flow conditions at the multiple prior times includes a plurality of prior traffic flow values that are each associated with one of the prior times and one of the plurality of locations, and wherein the automatic generating of the historical travel profile of the indicated portion of the road includes:

selecting the multiple time periods for use in aggregating the received information about the prior road traffic conditions, the multiple time periods each being based at least in part on time-of-day information;

determining multiple traffic flow aggregation classifications for which representative traffic flow conditions information will be distinctly represented in the generated historical travel profile, each of the traffic flow aggregation classifications corresponding to one of the plurality of distinct combinations and including at least one of the plurality of locations and one of the time periods; and for each of the traffic flow aggregation classifications, generating representative traffic flow conditions information that represents prior traffic that occurred at the at least one location for the traffic flow aggregation classification during the one time period for the traffic flow aggregation classification, the generating of the representative traffic flow conditions information being based at least in part on aggregating multiple of the prior traffic flow values that are associated with those at least one locations and with one or more prior times to which that one time period corresponds, on determining a typical traffic flow conditions value based on the aggregated prior traffic flow values, and on using the determined typical traffic flow conditions value as the generated representative traffic flow conditions information for the traffic flow aggregation classification.

5. The method of claim 4 wherein the prior traffic flow values each include a traffic speed of one or more vehicles, and wherein the determined typical traffic flow conditions values represent average traffic speeds of multiple vehicles.

6. The method of claim 4 wherein the obtained information indicating the actual traffic flow conditions of the vehicle at the two or more locations includes multiple actual traffic flow conditions values for the vehicle that are each associated with one of the two or more locations and with an indicated time, and wherein the fitting of the actual travel path of the vehicle to the representative traffic flow conditions indicated by the generated historical travel profile includes, for each of at least some of the actual traffic flow conditions values for the vehicle, determining one of the traffic flow aggregation classifications that includes the associated location for the actual traffic flow conditions value and that includes a time period to which the associated indicated time for the actual traffic flow conditions value corresponds, and retrieving the determined typical traffic flow conditions value for the determined one traffic flow aggregation classification; and determining a numerical difference between the actual traffic flow conditions value and the retrieved determined typical traffic flow conditions value.

7. The method of claim 6 wherein the fitting of the actual travel path of the vehicle to the representative traffic flow conditions indicated by the generated historical travel profile further includes, for each of one or more of the other locations, determining one of the multiple time periods to which the other location corresponds for the actual travel path of the vehicle;

identifying one of the traffic flow aggregation classifications that includes the other location and that includes the determined one time period, and retrieving the determined typical traffic flow conditions value for the identified one traffic flow aggregation classification;

adjusting the retrieved determined typical traffic flow conditions value for the identified one traffic flow aggregation classification based at least in part on one or more of the determined numerical differences for the actual traffic flow conditions values; and selecting the adjusted typical traffic flow conditions value as the expected traffic flow conditions of the vehicle for the other location.

8. The method of claim 4 wherein the fitting of the actual travel path of the vehicle to the representative traffic flow conditions indicated by the generated historical travel profile further includes, for each of one or more of the other locations, determining one of the multiple time periods to which the other location corresponds for the actual travel path of the vehicle;

identifying one of the traffic flow aggregation classifications that includes the other location and that includes the determined one time period, and retrieving the determined typical traffic flow conditions value for the identified one traffic flow aggregation classification;

identifying another of the traffic flow aggregation classifications that includes another second location distinct from the other location, and retrieving the determined typical traffic flow conditions value for the identified another traffic flow aggregation classification;

determining that the retrieved determined typical traffic flow conditions value for the identified another traffic flow aggregation classification is a better match for the actual travel path of the vehicle than the retrieved determined typical traffic flow conditions value for the identified one traffic flow aggregation classification; and selecting the retrieved determined typical traffic flow conditions value for the identified another traffic flow aggregation classification to be used as the expected traffic flow conditions of the vehicle for the other location.

9. The method of claim 4 wherein the fitting of the actual travel path of the vehicle to the representative traffic flow conditions indicated by the generated historical travel profile further includes, for each of one or more of the other locations, determining one of the multiple time periods to which the other location corresponds for the actual travel path of the vehicle;

identifying one of the traffic flow aggregation classifications that includes the other location and that includes the determined one time period, and retrieving the determined typical traffic flow conditions value for the identified one traffic flow aggregation classification;

identifying another of the traffic flow aggregation classifications that includes another second time period distinct from the determined one time period, and retrieving the determined typical traffic flow conditions value for the identified another traffic flow aggregation classification;

determining that the retrieved determined typical traffic flow conditions value for the identified another traffic flow aggregation classification is a better match for the actual travel path of the vehicle than the retrieved determined typical traffic flow conditions value for the identified one traffic flow aggregation classification; and selecting the retrieved determined typical traffic flow conditions value for the identified another traffic flow aggregation classification to be used as the expected traffic flow conditions of the vehicle for the other location.

10. The method of claim 1 wherein the one or more traffic flow obstructions on the indicated portion of the road are one or more structural traffic flow obstructions that are part of the indicated portion of the road, the one or more structural traffic flow obstructions including at least one of one or more traffic signal lights, of one or more stop signs, or of one or more traffic intersections with other roads.

11. The method of claim 1 wherein the one or more programmed computing systems are part of an estimated traffic information provider system, and wherein the method further comprises, under control of the one or more programmed computing systems, using the generated historical travel profile of the indicated portion of the road to automatically calculate expected traffic flow conditions for travel paths of multiple vehicles that travel along the indicated portion of the road.

12. The method of claim 1 wherein the one or more programmed computing systems are associated with the vehicle, and wherein the obtained information about the actual travel path of the vehicle includes a plurality of data samples that each reports an actual traffic speed of the vehicle at an indicated time and at an indicated associated road location, the data samples being generated by a device associated with the vehicle that is one of the one or more programmed computing systems.

13. A non-transitory computer-readable storage medium having stored contents that configure a computing device to perform a method, the method comprising:

obtaining a generated travel profile of an indicated portion of a road that indicates differing representative traffic flow conditions for a plurality of locations on the indicated portion of the road, the generated travel profile being based on information about prior road traffic flow conditions for the indicated portion of the road and reflecting one or more flow obstructions that reduce traffic flow for at least one location of the plurality of locations;

obtaining information about an actual travel path of a vehicle as it previously passed over at least some of the indicated portion of the road and passed multiple locations of the plurality of locations, the obtained information indicating actual traffic flow conditions for the vehicle at a subset of two or more of the multiple locations and not indicating actual traffic flow conditions for the vehicle at one or more other locations of the multiple locations, wherein the other locations include locations between the two or more locations of the subset that the vehicle passed by without a device associated with the vehicle generating a corresponding data sample;

automatically calculating, by the configured computing device, expected traffic flow conditions for the vehicle for the one or more other locations by adapting at least some of the obtained information for the actual travel path of the vehicle to the representative traffic flow conditions from the generated travel profile; and providing one or more indications of the automatically calculated expected traffic flow conditions of the vehicle.

14. The computer-readable storage medium of claim 13 wherein the one or more flow obstructions are one or more structural traffic flow obstructions located at the at least one location of the indicated portion of the road, and wherein the obtaining of the generated travel profile of the indicated portion of the road includes:

receiving information about the prior road traffic flow conditions for the indicated portion of the road, the information about the prior road traffic flow conditions reflecting prior travel of a plurality of vehicles on the indicated portion of the road at a plurality of prior times and further reflecting the one or more structural traffic flow obstructions that reduce traffic flow for the at least one location on the indicated portion of the road; and automatically generating, by the configured computing device, the travel profile of the indicated portion of the road based at least in part on the received information about the prior road traffic flow conditions, wherein the differing representative traffic flow conditions indicated by the generated travel profile further correspond to multiple periods of time.

15. The computer-readable storage medium of claim 14 wherein the obtained information about the actual travel path of the vehicle corresponds to a first of the multiple periods of time, and wherein the automatic calculating of the expected traffic flow conditions for the vehicle includes fitting the actual travel path of the vehicle to the representative traffic flow conditions from the generated travel profile for the other locations by adjusting those representative traffic flow conditions to reflect differences between the actual traffic flow conditions for the vehicle at the two or more locations from the obtained information and the representative traffic flow conditions from the generated travel profile for the two or more locations and to reflect representative traffic flow conditions from the generated travel profile for one or more of the multiple periods of time that are distinct from the first period of time.

16. The computer-readable storage medium of claim 13 wherein the vehicle has not yet reached one or more other parts of the indicated portion of the road that are distinct from the at least some indicated portion of the road, and wherein the providing of the one or more indications of the automatically calculated expected traffic flow conditions of the vehicle further includes dynamically using additional automatically calculated expected traffic flow conditions of the vehicle for one or more locations along the one or more other parts of the indicated portion of the road that the vehicle has not yet reached, to assist future travel of the vehicle over the one or more other parts of the indicated portion of the road.

17. The computer-readable storage medium of claim 13 wherein the automatic calculating of the expected traffic flow conditions for the vehicle includes fitting the actual travel path of the vehicle to the representative traffic flow conditions from the generated travel profile for the other locations by adjusting those representative traffic flow conditions from the generated travel profile for the other locations to reflect differences between the actual traffic flow conditions for the vehicle at the two or more locations from the obtained information and the representative traffic flow conditions from the generated travel profile for the two or more locations.

18. The computer-readable storage medium of claim 13 wherein the configured computing device is part of an estimated traffic information provider system, wherein the method further comprises, under control of the configured computing device of the estimated traffic information provider system, using the generated travel profile of the indicated portion of the road to automatically calculate expected traffic flow conditions for travel paths of multiple vehicles that travel along the indicated portion of the road, wherein the computer-readable storage medium is a memory of the computing device, and wherein the contents are instructions that when executed program the computing device to perform the method.

19. A computing system, comprising:

one or more processors; and one or more modules that are configured to, when executed by at least one of the one or more processors, generate expected traffic flow information for travel paths of multiple vehicles over one or more roads by, for each of the multiple vehicles:

obtaining a generated travel profile of an indicated portion of one of the one or more roads that indicates differing representative traffic flow conditions for a plurality of locations on the indicated portion of the road, the generated travel profile being based on information about prior road traffic flow conditions for the indicated portion of the road and reflecting one or more flow obstructions that reduce traffic flow at one or more locations of the plurality of locations;

obtaining information about an actual travel path of the vehicle that includes at least some of the indicated portion of the road, the obtained information indicating actual traffic flow conditions for the vehicle at a subset of two or more of the plurality of locations of the indicated portion of the road;

automatically calculating expected traffic flow conditions for the vehicle for at least some of the plurality of locations of the indicated portion of the road that the vehicle previously passed during the actual travel path and that are not part of the subset for which the obtained information indicates the actual traffic flow conditions, wherein the at least some locations include locations between the two or more locations of the subset that the vehicle passed by without a device associated with the vehicle generating a corresponding data sample, and wherein the automatic calculating of the expected traffic flow conditions includes fitting at least some of the obtained information for the actual travel path of the vehicle to the representative traffic flow conditions from the generated travel profile; and providing one or more indications of the automatically calculated expected traffic flow conditions of the vehicle.

20. The computing system of claim 19 wherein the computing system further comprises an additional module that is configured to generate multiple travel profiles for multiple indicated portions of multiple roads, wherein the obtaining of the generated travel profile of the indicated portion of the road for each of the multiple vehicles includes retrieving one of the generated multiple travel profiles, and wherein, for one of the multiple vehicles, the one or more flow obstructions that reduce traffic flow at the one or more locations on the indicated portion of the road for the one vehicle are one or more structural traffic flow obstructions located at those one or more locations, and the generating by the additional module of the travel profile for the indicated portion of the road that is retrieved for the one vehicle includes:

receiving information about the prior road traffic flow conditions for the indicated portion of the road, the information about the prior road traffic flow conditions reflecting prior travel of a plurality of vehicles on the indicated portion of the road at a plurality of prior times and further reflecting the one or more structural traffic flow obstructions that reduce traffic flow at the one or more locations on the indicated portion of the road; and automatically generating the travel profile of the indicated portion of the road based at least in part on the received information about the prior road traffic conditions, the differing representative traffic flow conditions indicated by the generated travel profile further corresponding to multiple periods of time.

21. The computing system of claim 20 wherein the obtained information about the actual travel path of the one vehicle corresponds to a first of the multiple periods of time, and wherein the automatic calculating of the expected traffic flow conditions for the one vehicle includes fitting the actual travel path of the one vehicle to the representative traffic flow conditions from the generated travel profile for the first period of time and for the at least some locations of the indicated portion of the road that are not part of the subset by adjusting those representative traffic flow conditions to reflect differences between the actual traffic flow conditions for the one vehicle at the two or more locations from the obtained information and the representative traffic flow conditions from the generated travel profile for the two or more locations.

22. The computing system of claim 20 wherein the actual travel path of the one vehicle corresponds to travel by the one vehicle along the at least some indicated portion of the road, wherein the one vehicle has not yet reached one or more other parts of the indicated portion of the road that are distinct from the at least some indicated portion of the road, and wherein the providing of the one or more indications of the automatically calculated expected traffic flow conditions of the one vehicle further includes dynamically using additional automatically calculated expected traffic flow conditions of the one vehicle for one or more locations along the one or more other parts of the indicated portion of the road that the one vehicle has not yet reached, to assist future travel of the one vehicle over the one or more other parts of the indicated portion of the road.

23. The computing system of claim 20 wherein the one or more modules and the additional module include a historical data manager module, a current data manager module and a current traffic condition estimator module, and wherein the historical data manager module, the current data manager module and the current traffic condition estimator module each have software instructions for execution by the one or more processors.

24. The computing system of claim 19 wherein the one or more roads include multiple roads, wherein the obtained generated travel profiles for the multiple vehicles include multiple distinct travel profiles for indicated portions of the multiple roads, wherein the one or more modules are part of an estimated traffic information provider system that facilitates travel of the multiple vehicles on the multiple roads, and wherein the automatic calculating of the expected traffic flow conditions for each of the multiple vehicles includes fitting the actual travel path of the vehicle to the representative traffic flow conditions from the generated travel profile for the at least some locations of the indicated portion of the road that are not part of the subset for the vehicle by adjusting those representative traffic flow conditions to reflect differences between the actual traffic flow conditions for the vehicle at the two or more locations from the obtained information and the representative traffic flow conditions from the generated travel profile for the two or more locations.

25. The computing system of claim 19 wherein the one or more modules consist of a means for performing the generating of the expected traffic flow information for the travel paths of the multiple vehicles over the one or more roads.

26. A computer-implemented method comprising:

obtaining a generated travel profile of an indicated portion of a road that indicates differing representative traffic flow conditions for a plurality of locations on the indicated portion of the road, the generated travel profile being based on information about prior road traffic flow conditions for the indicated portion of the road and reflecting one or more flow obstructions that reduce traffic flow at one or more of the plurality of locations;

automatically generating multiple data samples that reflect actual traffic flow conditions for a vehicle at a subset of multiple of the plurality of locations of the indicated portion of the road, wherein the vehicle has an actual travel path that includes at least some of the indicated portion of the road and that corresponds to at least some of the multiple data samples, and wherein the multiple data samples are generated periodically by a configured computing device traveling with the vehicle and include data for two or more locations of the subset and do not include data corresponding to some locations that the vehicle has passed between the two or more locations of the subset;

automatically calculating, by the configured computing device, expected traffic flow conditions for the vehicle for the some locations by fitting the actual travel path of the vehicle to the representative traffic flow conditions from the generated travel profile; and providing by the configured computing device one or more indications of the automatically calculated expected traffic flow conditions of the vehicle to one or more users in the vehicle to facilitate further travel of the vehicle.

27. The method of claim 26 wherein the obtaining of the generated travel profile of the indicated portion of the road includes:

receiving information about the prior road traffic flow conditions for the indicated portion of the road, the information about the prior road traffic flow conditions reflecting prior travel of a plurality of vehicles on the indicated portion of the road at a plurality of prior times and further reflecting the one or more flow obstructions that reduce traffic flow at the one or more locations on the indicated portion of the road; and automatically generating, by the configured computing device, the travel profile of the indicated portion of the road based at least in part on the received information about the prior road traffic conditions, the differing representative traffic flow conditions indicated by the generated travel profile further corresponding to multiple periods of time.

28. The method of claim 24 wherein the information about the prior road traffic flow conditions is based on prior travel of a plurality of vehicles on the indicated portion of the road at a plurality of prior times, wherein the generated travel profile indicates differing historical representative traffic flow conditions for the indicated portion of the road that reflect multiple periods of time, wherein the at least some data samples are generated at times that correspond to a first of the multiple periods of time, and wherein the automatic calculating of the expected traffic flow conditions for the vehicle includes fitting the actual travel path of the vehicle to the historical representative traffic flow conditions from the generated travel profile for the some locations by adjusting those representative traffic flow conditions to reflect differences between the actual traffic flow conditions for the vehicle at the multiple locations from the generated data samples and the historical representative traffic flow conditions from the generated travel profile for the multiple locations and to reflect historical representative traffic flow conditions from the generated travel profile for one or more of the multiple periods of time that are distinct from the first period of time.

29. The method of claim 26 wherein the actual travel path of the vehicle corresponds to travel by the vehicle along the at least some indicated portion of the road, wherein the vehicle has not yet reached one or more other parts of the indicated portion of the road that are distinct from the at least some indicated portion of the road, and wherein the providing of the one or more indications of the automatically calculated expected traffic flow conditions of the vehicle further includes dynamically using additional automatically calculated expected traffic flow conditions of the vehicle for one or more locations along the one or more other parts of the indicated portion of the road that the vehicle has not yet reached, to assist future travel of the vehicle over the one or more other parts of the indicated portion of the road.

30. The method of claim 26 wherein the automatic calculating of the expected traffic flow conditions for the vehicle includes fitting the actual travel path of the vehicle to the representative traffic flow conditions from the generated travel profile for the some locations by adjusting those representative traffic flow conditions from the generated travel profile to reflect differences between the actual traffic flow conditions for the vehicle at the multiple locations from the generated data samples and the representative traffic flow conditions from the generated travel profile for the multiple locations.

31. The method of claim 26 wherein the obtaining of the generated travel profile of the indicated portion of the road includes receiving the generated travel profile from a remote estimated traffic information provider system, and wherein the method further comprises providing by the configured computing device the automatically calculated expected traffic flow conditions of the vehicle to the estimated traffic information provider system to facilitate future travel by other vehicles on the indicated portion of the road.

* * * * *

UNITED STATES PATENT AND TRADEMARK OFFICE

CERTIFICATE OF CORRECTION

PATENT NO. : 9,257,041 B2
APPLICATION NO. : 12/765742
DATED : February 9, 2016
INVENTOR(S) : Christopher Laurence Scofield et al.

It is certified that error appears in the above-identified patent and that said Letters Patent is hereby corrected as shown below:

Claims

Column 34, Line 35:
"28. The method of claim 24 wherein the information about" should read, --28. The method of claim 26 wherein the information about--.

Signed and Sealed this
Twenty-sixth Day of July, 2016

Michelle K. Lee

Michelle K. Lee
*Director of the United States Patent and Trademark Office*